US011232672B2

(12) United States Patent
Sanborn et al.

(10) Patent No.: US 11,232,672 B2
(45) Date of Patent: Jan. 25, 2022

(54) PERSISTENT MOVING SYMBOLS FOR A WAGERING GAME

(71) Applicant: Aristocrat Technologies, Inc., Las Vegas, NV (US)

(72) Inventors: Hanna Sanborn, Georgetown, TX (US); Rogelio Decasa, Jr., Renton, WA (US); Chad La Guardia, Austin, TX (US); Erick Ching, Cedar Park, TX (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 30 days.

(21) Appl. No.: 16/805,564

(22) Filed: Feb. 28, 2020

(65) Prior Publication Data

US 2021/0217272 A1 Jul. 15, 2021

Related U.S. Application Data

(60) Provisional application No. 62/959,494, filed on Jan. 10, 2020.

(51) Int. Cl.
*G07F 17/32* (2006.01)
*G07F 17/34* (2006.01)

(52) U.S. Cl.
CPC ..... *G07F 17/3213* (2013.01); *G07F 17/3267* (2013.01); *G07F 17/34* (2013.01)

(58) Field of Classification Search
CPC ..... G07F 17/3267; G07F 17/3213; G07F 17/3244; G07F 17/34
See application file for complete search history.

(56) References Cited

U.S. PATENT DOCUMENTS 5,833,537 A * 11/1998 Barrie ..... G07F 17/3265 463/21
6,551,187 B1 4/2003 Jaffe
7,578,740 B2 8/2009 Marks et al.
8,992,301 B2 3/2015 Caputo et al.
9,028,318 B2 5/2015 Caputo et al.
(Continued)

OTHER PUBLICATIONS

International Search Report and Written Opinion for App. No. PCT/US20/27542, dated Jun. 26, 2020, 7 pages.
(Continued)

*Primary Examiner* — Justin L Myhr
(74) *Attorney, Agent, or Firm* — Weaver Austin Villeneuve & Sampson LLP

(57) ABSTRACT

Some implementations may involve providing a slot game in which the game outcome presentation may involve displaying a persistent moving symbol. In some examples, an initial persistent moving symbol position may be based, at least in part, on a first bet level. Determining a game outcome may involve determining whether a persistent moving symbol position is a prize-triggering persistent moving symbol position. If an initial persistent moving symbol position is not a prize-triggering persistent moving symbol position, a persistent moving symbol may be presented in a secondary persistent moving symbol position of a next game outcome. The secondary persistent moving symbol position may be closer to the prize-triggering persistent moving symbol position than the initial persistent moving symbol position.

20 Claims, 24 Drawing Sheets

(56) References Cited

U.S. PATENT DOCUMENTS

| | | | | |
|---|---|---|---|---|
| 9,318,002 | B2 | 4/2016 | Caputo et al. | |
| 9,633,511 | B2 | 4/2017 | Caputo et al. | |
| 9,685,033 | B2 | 6/2017 | Linard et al. | |
| 9,881,459 | B2 | 1/2018 | Caputo et al. | |
| 10,186,106 | B2 | 1/2019 | Hughes et al. | |
| 10,733,834 | B1 * | 8/2020 | Hiten | G07F 17/3213 |
| 2003/0190947 | A1 | 10/2003 | Baerlocher et al. | |
| 2003/0190948 | A1 | 10/2003 | Baerlocher et al. | |
| 2004/0048646 | A1 | 3/2004 | Visocnik | |
| 2006/0030387 | A1 | 2/2006 | Jackson | |
| 2008/0064466 | A1 * | 3/2008 | Saito | G07F 17/34 463/16 |
| 2010/0304833 | A1 * | 12/2010 | Berman | G07F 17/34 463/20 |
| 2014/0162748 | A1 | 6/2014 | Ryan | |
| 2014/0162750 | A1 | 6/2014 | Ryan | |
| 2014/0256410 | A1 * | 9/2014 | Basallo | G07F 17/34 463/25 |
| 2014/0323198 | A1 * | 10/2014 | Tuck | G07F 17/323 463/20 |
| 2015/0057068 | A1 * | 2/2015 | Burghard | G07F 17/34 463/20 |
| 2016/0232740 | A1 | 8/2016 | Janosov | |
| 2017/0039802 | A1 * | 2/2017 | Prabhu | G07F 17/3211 |
| 2017/0132877 | A1 * | 5/2017 | Marks | G07F 17/3213 |

OTHER PUBLICATIONS

Slotmanjack Slot Machine Jackpots. "All 15 Buffalo Gold Heads $11 Bet! Insanity!" YouTube; Video (online). Aug. 3, 2018 (retrieved Jun. 8, 2020). Retrieved from the Internet: <URL: https://www.youtube.com/watch?v=IN5zvBjIVsl.>.

* cited by examiner 705 710 715 720 725 730 735 740

Award Persistent Moving Symbol (PMS) Table

| | | | Bet1 | Bet 2 | Bet 3 | Bet 4 | Bet 5 |
|---|---|---|---|---|---|---|---|
| PMS? | Reel | Row | Weight | Weight | Weight | Weight | Weight |
| No | 0 | 0 | 10000 | 11200 | 12400 | 13600 | 14800 |
| RandomWilds | 0 | 0 | 800 | 950 | 1100 | 1250 | 1400 |
| Yes | 1 | 2 | 40 | 48 | 56 | 64 | 72 |
| Yes | 1 | 3 | 40 | 48 | 56 | 64 | 72 |
| Yes | 2 | 2 | 50 | 58 | 66 | 74 | 82 |
| Yes | 2 | 3 | 50 | 58 | 66 | 74 | 82 |
| Yes | 3 | 2 | 30 | 38 | 46 | 54 | 62 |
| Yes | 3 | 3 | 30 | 38 | 46 | 54 | 62 |
| Yes | 4 | 2 | 20 | 28 | 36 | 44 | 52 |
| Yes | 4 | 3 | 20 | 28 | 36 | 44 | 52 |
| Yes | 5 | 2 | 10 | 18 | 26 | 34 | 42 |
| Yes | 5 | 3 | 10 | 18 | 26 | 34 | 42 |
| | | | 11100 | 12530 | 13960 | 15390 | 16820 |

700

FIG. 7

Exploding Wilds Table

| # of Adj Wilds | Reel1 Weight | Reel2 Weight | Reel3 Weight | Reel4 Weight | Reel5 Weight |
|---|---|---|---|---|---|
| 0 | 0 | 0 | 0 | 0 | 0 |
| 1 | 120 | 88 | 25 | 23 | 15 |
| 2 | 80 | 102 | 42 | 50 | 42 |
| 3 | 42 | 50 | 35 | 85 | 43 |
| 4 | 20 | 43 | 18 | 17 | 50 |
| 5 | 5 | 22 | 35 | 42 | 35 |
| 6 | 0 | 10 | 22 | 15 | 0 |
| 7 | 0 | 5 | 4 | 3 | 0 |
| 8 | 0 | 1 | 1 | 1 | 0 |
| | 267 | 321 | 182 | 236 | 185 |

PERSISTENT MOVING SYMBOLS FOR A WAGERING GAME

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

SUMMARY

One innovative aspect of the subject matter described in this disclosure may be implemented in an apparatus. The apparatus may include an interface system, a display system and a control system. In some examples, the apparatus may be a gaming device. The interface system may, in some instances, include at least one network interface and at least one user interface.

The control system may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. According to some examples, the control system may be configured for receiving, via the interface system, user input corresponding to a first bet level and user input for initiation of a first instance of a slot game. The control system may be configured for determining a first game outcome and corresponding first display symbols for the first instance of the slot game.

Determining the first game outcome may, in some instances, involve determining that one of the first display symbols is a persistent moving symbol. Determining the first game outcome may involve determining an initial persistent moving symbol position that may be based, at least in part, on the first bet level. Determining the first game outcome may involve determining whether the initial persistent moving symbol position is a prize-triggering persistent moving symbol position.

The control system may be configured for controlling the display system to display the first game outcome. Displaying the first game outcome may involve displaying the first display symbols at a plurality of display symbol positions on a display device of the display system. The plurality of display symbol positions may, for example, be arranged in a plurality of display symbol rows and display symbol columns.

The control system may be configured for receiving, via the interface system, user input for initiation of a second instance of the slot game and for determining a second game outcome and corresponding second display symbols for the second instance of the wagering game. If determining the first game outcome involved determining that the initial persistent moving symbol position was not a prize-triggering persistent moving symbol position, determining the second game outcome may involve determining that one of the second display symbols is the persistent moving symbol and determining that a secondary persistent moving symbol position will be a display symbol position that is at least one of a display symbol row or a display symbol column towards the prize-triggering persistent moving symbol position, relative to the initial persistent moving symbol position. The control system may be configured for controlling the display system to display the second game outcome.

In some examples, the initial persistent moving symbol position may be an initial display symbol row and an initial display symbol column. The initial display symbol column may, in some instances, correspond to the first bet level.

According to some examples, displaying the second game outcome may involve presenting the persistent moving symbol in a secondary persistent moving symbol position. The secondary persistent moving symbol position may, in some instances, be the initial display symbol row and a secondary display symbol column. The secondary display symbol column may, in some instances, be adjacent to the initial display symbol column.

In some implementations, a prize triggered by the prize-triggering persistent moving symbol position may be a progressive jackpot. The progressive jackpot may, for example, correspond to the initial display symbol row. In some instances, the progressive jackpot may be one of a plurality of progressive jackpots. A prize symbol for each of the plurality of progressive jackpots may, in some examples, be displayed adjacent the plurality of display symbol positions.

According to some examples, the prize-triggering persistent moving symbol position may be one of a plurality of prize-triggering persistent moving symbol positions. The plurality of prize-triggering persistent moving symbol positions may, in some examples, be arranged in a display symbol row or a display symbol column.

For example, the plurality of prize-triggering persistent moving symbol positions may be arranged in a prize-triggering display symbol column and prize symbols corresponding to prizes triggered by each of the prize-triggering persistent moving symbol positions may be displayed in a prize symbol column that is displayed adjacent to the prize-triggering display symbol column. In some such examples, one or more of the prize symbols may remain in a single row of the prize symbol column during multiple instances of the slot game. In other examples, at least one of the prize symbols may be a moving prize symbol that is displayed in different rows of the prize symbol column during different instances of the slot game. The moving prize symbol may, in some instances, correspond to the persistent moving symbol. According to some implementations, the moving prize symbol may correspond to a maximum prize that may be obtained when the persistent moving symbol is in the prize-triggering persistent moving symbol position.

In some implementations, determining the first game outcome may involve making a random number generator (RNG) call to a game processing backend system to determine whether one or more wild symbols will be presented adjacent to the initial persistent moving symbol position. The wild symbols may, in some examples, include exploding wild symbols. In some instances, an RNG outcome based on the RNG call may indicate that one or more wild symbols will be presented adjacent to the initial persistent moving symbol position. An RNG conversion engine may refer to a data structure, such as a weighted lookup table, in order to determine a display symbol position for each of the one or more wild symbols.

According to some implementations, the control system may be further configured for determining whether one of the first display symbols is a persistent moving symbol. Determining whether one of the first display symbols is a persistent moving symbol may involve making a random number generator (RNG) call to a game processing backend system, determining an RNG outcome based on the RNG call and providing the RNG outcome to an RNG conversion engine. The RNG conversion engine may, for example, refer to a data structure, such as a weighted lookup table, in order to determine whether one of the first display symbols is a persistent moving symbol.

In some examples, the initial persistent moving symbol position is not the prize-triggering persistent moving symbol position. The control system may be further configured to award a multiplier at a display symbol position between the initial persistent moving symbol position and the prize-triggering persistent moving symbol position. The multiplier may, in some examples, persist for more than one game instance.

According to some implementations, the control system may be further configured for controlling the display system for presenting a feature game when it is determined that a persistent moving symbol position is a prize-triggering persistent moving symbol position. Presenting the feature game may involve presenting an additional reel and spinning the additional reel to reveal an award of the feature game.

Still other innovative aspects of the subject matter described in this disclosure can be implemented in a gaming method. The method may involve receiving, via an interface system, user input corresponding to a first bet level and user input for initiation of a first instance of a slot game. The method may involve determining a first game outcome and corresponding first display symbols for the first instance of the slot game.

Determining the first game outcome may, in some instances, involve determining that one of the first display symbols is a persistent moving symbol. Determining the first game outcome may involve determining an initial persistent moving symbol position that may be based, at least in part, on the first bet level. Determining the first game outcome may involve determining whether the initial persistent moving symbol position is a prize-triggering persistent moving symbol position.

The method may involve controlling a display system to display the first game outcome. Displaying the first game outcome may involve displaying the first display symbols at a plurality of display symbol positions on a display device of the display system. The plurality of display symbol positions may be arranged in a plurality of display symbol rows and display symbol columns.

The method may involve receiving, via the interface system, user input for initiation of a second instance of the slot game and for determining a second game outcome and corresponding second display symbols for the second instance of the wagering game. If determining the first game outcome involved determining that the initial persistent moving symbol position was not a prize-triggering persistent moving symbol position, determining the second game outcome may involve determining that one of the second display symbols is the persistent moving symbol and determining that a secondary persistent moving symbol position will be a display symbol position that is at least one of a display symbol row or a display symbol column towards the prize-triggering persistent moving symbol position, relative to the initial persistent moving symbol position. The method may involve controlling the display system to display the second game outcome.

In some examples, the initial persistent moving symbol position may be an initial display symbol row and an initial display symbol column. The initial display symbol column may, in some instances, correspond to the first bet level.

According to some examples, displaying the second game outcome may involve presenting the persistent moving symbol in a secondary persistent moving symbol position. The secondary persistent moving symbol position may, in some instances, be the initial display symbol row and a secondary display symbol column. The secondary display symbol column may, in some instances, be adjacent to the initial display symbol column.

In some implementations, a prize triggered by the prize-triggering persistent moving symbol position may be a progressive jackpot. The progressive jackpot may, for example, correspond to the initial display symbol row. In some instances, the progressive jackpot may be one of a plurality of progressive jackpots. A prize symbol for each of the plurality of progressive jackpots may, in some examples, be displayed adjacent the plurality of display symbol positions.

According to some examples, the prize-triggering persistent moving symbol position may be one of a plurality of prize-triggering persistent moving symbol positions. The plurality of prize-triggering persistent moving symbol positions may, in some examples, be arranged in a display symbol row or a display symbol column.

For example, the plurality of prize-triggering persistent moving symbol positions may be arranged in a prize-triggering display symbol column and prize symbols corresponding to prizes triggered by each of the prize-triggering persistent moving symbol positions may be displayed in a prize symbol column that is displayed adjacent to the prize-triggering display symbol column. In some such examples, one or more of the prize symbols may remain in a single row of the prize symbol column during multiple instances of the slot game. In other examples, at least one of the prize symbols may be a moving prize symbol that is displayed in different rows of the prize symbol column during different instances of the slot game. The moving prize symbol may, in some instances, correspond to the persistent moving symbol. According to some implementations, the moving prize symbol may correspond to a maximum prize that may be obtained when the persistent moving symbol is in the prize-triggering persistent moving symbol position.

In some implementations, determining the first game outcome may involve making a random number generator (RNG) call to a game processing backend system to determine whether one or more wild symbols will be presented adjacent to the initial persistent moving symbol position. The wild symbols may, in some examples, include exploding wild symbols. In some instances, an RNG outcome based on the RNG call may indicate that one or more wild symbols will be presented adjacent to the initial persistent moving symbol position. An RNG conversion engine may refer to a data structure, such as a weighted lookup table, in order to determine a display symbol position for each of the one or more wild symbols.

According to some implementations, the method may involve determining whether one of the first display symbols is a persistent moving symbol. Determining whether one of the first display symbols is a persistent moving symbol may involve making a random number generator (RNG) call to a game processing backend system, determining an RNG outcome based on the RNG call and providing the RNG outcome to an RNG conversion engine. The RNG conversion engine may, for example, refer to a data structure, such as a weighted lookup table, in order to determine whether one of the first display symbols is a persistent moving symbol.

In some examples, the initial persistent moving symbol position is not the prize-triggering persistent moving symbol position. The method may involve awarding a multiplier at a display symbol position between the initial persistent moving symbol position and the prize-triggering persistent moving symbol position. The multiplier may, in some examples, persist for more than one game instance.

According to some implementations, the method may involve controlling the display system for presenting a feature game when it is determined that a persistent moving symbol position is a prize-triggering persistent moving symbol position. Presenting the feature game may involve presenting an additional reel and spinning the additional reel to reveal an award of the feature game.

Some or all of the operations, functions and/or methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, some innovative aspects of the subject matter described in this disclosure can be implemented in one or more non-transitory media having software stored thereon.

For example, the software may include instructions for controlling one or more devices to perform a gaming method. In some examples, the method may involve receiving, via an interface system, user input corresponding to a first bet level and user input for initiation of a first instance of a slot game. The method may involve determining a first game outcome and corresponding first display symbols for the first instance of the slot game.

Determining the first game outcome may, in some instances, involve determining that one of the first display symbols is a persistent moving symbol. Determining the first game outcome may involve determining an initial persistent moving symbol position that may be based, at least in part, on the first bet level. Determining the first game outcome may involve determining whether the initial persistent moving symbol position is a prize-triggering persistent moving symbol position.

The method may involve controlling a display system to display the first game outcome. Displaying the first game outcome may involve displaying the first display symbols at a plurality of display symbol positions on a display device of the display system. The plurality of display symbol positions may be arranged in a plurality of display symbol rows and display symbol columns.

The method may involve receiving, via the interface system, user input for initiation of a second instance of the slot game and for determining a second game outcome and corresponding second display symbols for the second instance of the wagering game. If determining the first game outcome involved determining that the initial persistent moving symbol position was not a prize-triggering persistent moving symbol position, determining the second game outcome may involve determining that one of the second display symbols is the persistent moving symbol and determining that a secondary persistent moving symbol position will be a display symbol position that is at least one of a display symbol row or a display symbol column towards the prize-triggering persistent moving symbol position, relative to the initial persistent moving symbol position. The method may involve controlling the display system to display the second game outcome.

In some examples, the initial persistent moving symbol position may be an initial display symbol row and an initial display symbol column. The initial display symbol column may, in some instances, correspond to the first bet level.

According to some examples, displaying the second game outcome may involve presenting the persistent moving symbol in a secondary persistent moving symbol position. The secondary persistent moving symbol position may, in some instances, be the initial display symbol row and a secondary display symbol column. The secondary display symbol column may, in some instances, be adjacent to the initial display symbol column.

In some implementations, a prize triggered by the prize-triggering persistent moving symbol position may be a progressive jackpot. The progressive jackpot may, for example, correspond to the initial display symbol row. In some instances, the progressive jackpot may be one of a plurality of progressive jackpots. A prize symbol for each of the plurality of progressive jackpots may, in some examples, be displayed adjacent the plurality of display symbol positions.

According to some examples, the prize-triggering persistent moving symbol position may be one of a plurality of prize-triggering persistent moving symbol positions. The plurality of prize-triggering persistent moving symbol positions may, in some examples, be arranged in a display symbol row or a display symbol column.

For example, the plurality of prize-triggering persistent moving symbol positions may be arranged in a prize-triggering display symbol column and prize symbols corresponding to prizes triggered by each of the prize-triggering persistent moving symbol positions may be displayed in a prize symbol column that is displayed adjacent to the prize-triggering display symbol column. In some such examples, one or more of the prize symbols may remain in a single row of the prize symbol column during multiple instances of the slot game. In other examples, at least one of the prize symbols may be a moving prize symbol that is displayed in different rows of the prize symbol column during different instances of the slot game. The moving prize symbol may, in some instances, correspond to the persistent moving symbol. According to some implementations, the moving prize symbol may correspond to a maximum prize that may be obtained when the persistent moving symbol is in the prize-triggering persistent moving symbol position.

In some implementations, determining the first game outcome may involve making a random number generator (RNG) call to a game processing backend system to determine whether one or more wild symbols will be presented adjacent to the initial persistent moving symbol position. The wild symbols may, in some examples, include exploding wild symbols. In some instances, an RNG outcome based on the RNG call may indicate that one or more wild symbols will be presented adjacent to the initial persistent moving symbol position. An RNG conversion engine may refer to a data structure, such as a weighted lookup table, in order to determine a display symbol position for each of the one or more wild symbols.

According to some implementations, the method may involve determining whether one of the first display symbols is a persistent moving symbol. Determining whether one of the first display symbols is a persistent moving symbol may involve making a random number generator (RNG) call to a game processing backend system, determining an RNG outcome based on the RNG call and providing the RNG outcome to an RNG conversion engine. The RNG conversion engine may, for example, refer to a data structure, such as a weighted lookup table, in order to determine whether one of the first display symbols is a persistent moving symbol.

In some examples, the initial persistent moving symbol position is not the prize-triggering persistent moving symbol position. The method may involve awarding a multiplier at a display symbol position between the initial persistent moving symbol position and the prize-triggering persistent moving symbol position. The multiplier may, in some examples, persist for more than one game instance.

According to some implementations, the method may involve controlling the display system for presenting a feature game when it is determined that a persistent moving symbol position is a prize-triggering persistent moving symbol position. Presenting the feature game may involve presenting an additional reel and spinning the additional reel to reveal an award of the feature game.

BRIEF DESCRIPTION OF THE DRAWINGS

FIG. 7 shows an example of a weighted table that may be used to determine whether a persistent moving symbol will be presented in a game outcome.

Figure 1:
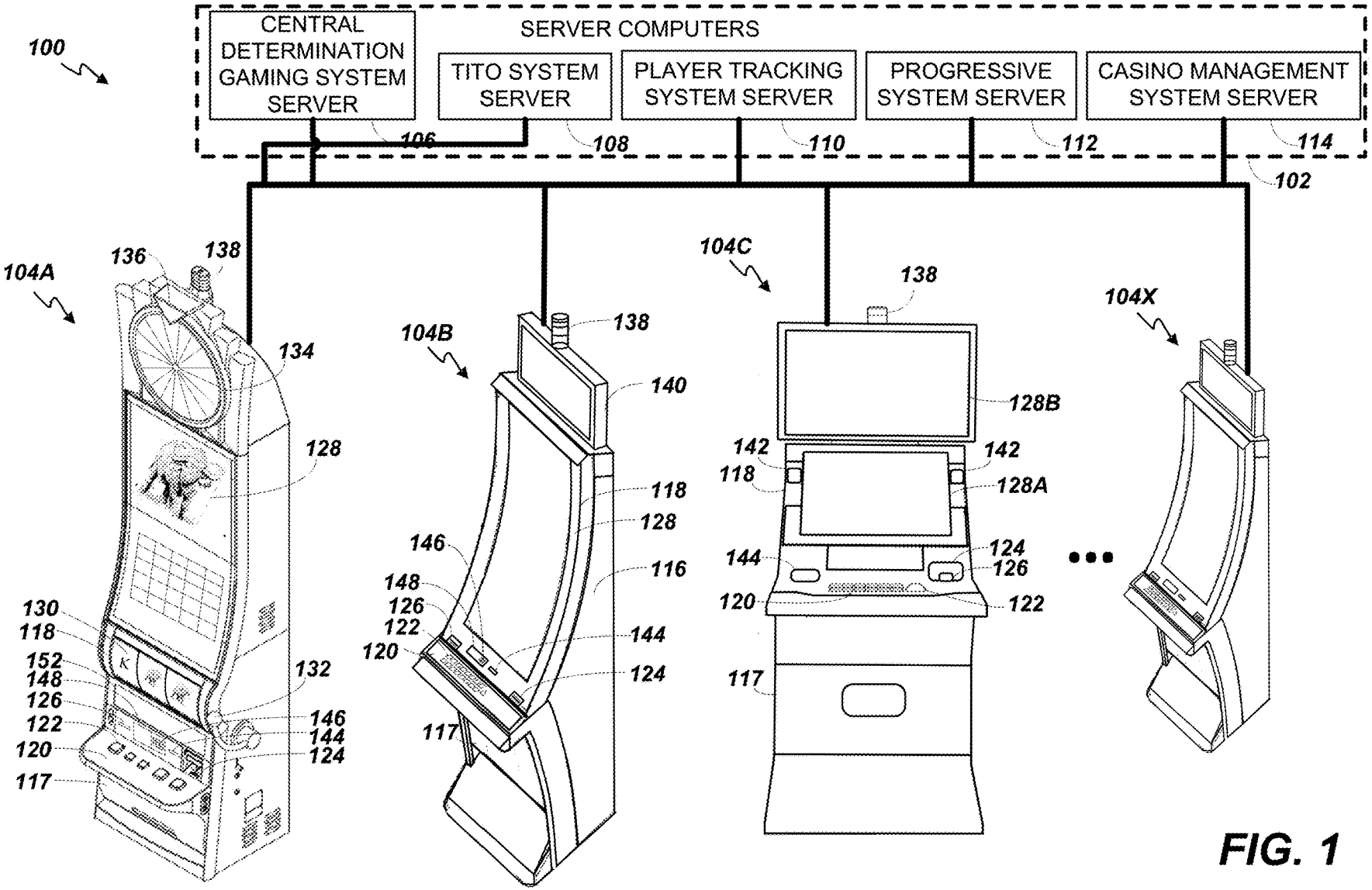
FIG. 1 is an example diagram showing several EGMs networked with various gaming-related servers.

The foregoing summary, as well as the following detailed description of certain embodiments of the present disclosure, will be better understood when read in conjunction with the appended drawings. For the purpose of illustrating the disclosure, certain embodiments are shown in the drawings. It should be understood, however, that the present disclosure is not limited to the arrangements and instrumentality shown in the attached drawings.

DETAILED DESCRIPTION

Some implementations may involve providing a slot game in which the game outcome presentation may involve displaying a persistent moving symbol. In some examples, an initial persistent moving symbol position may be based, at least in part, on a first bet level. Determining a game outcome may involve determining whether a persistent moving symbol position is a prize-triggering persistent moving symbol position. If an initial persistent moving symbol position is not a prize-triggering persistent moving symbol position, in some examples a persistent moving symbol will always be presented in the next game outcome. In some examples, a secondary persistent moving symbol position of the next game outcome will be closer to the prize-triggering persistent moving symbol position than the initial persistent moving symbol position.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a web site maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (Wi-Fi®) and Bluetooth®), cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 154 which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming device 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming device 104A can have hardware meters for purposes including ensuring regulatory compliance and monitoring the player credit balance. In addition, there can be additional meters that record the total amount of money wagered on the gaming machine, total amount of money deposited, total amount of money withdrawn, total amount of winnings on gaming device 104A.

In some embodiments, a player tracking card reader 144, a transceiver for wireless communication with a mobile device (e.g., a player's smartphone), a keypad 146, and/or an illuminated display 148 for reading, receiving, entering, and/or displaying player tracking information is provided in gaming device 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2A:
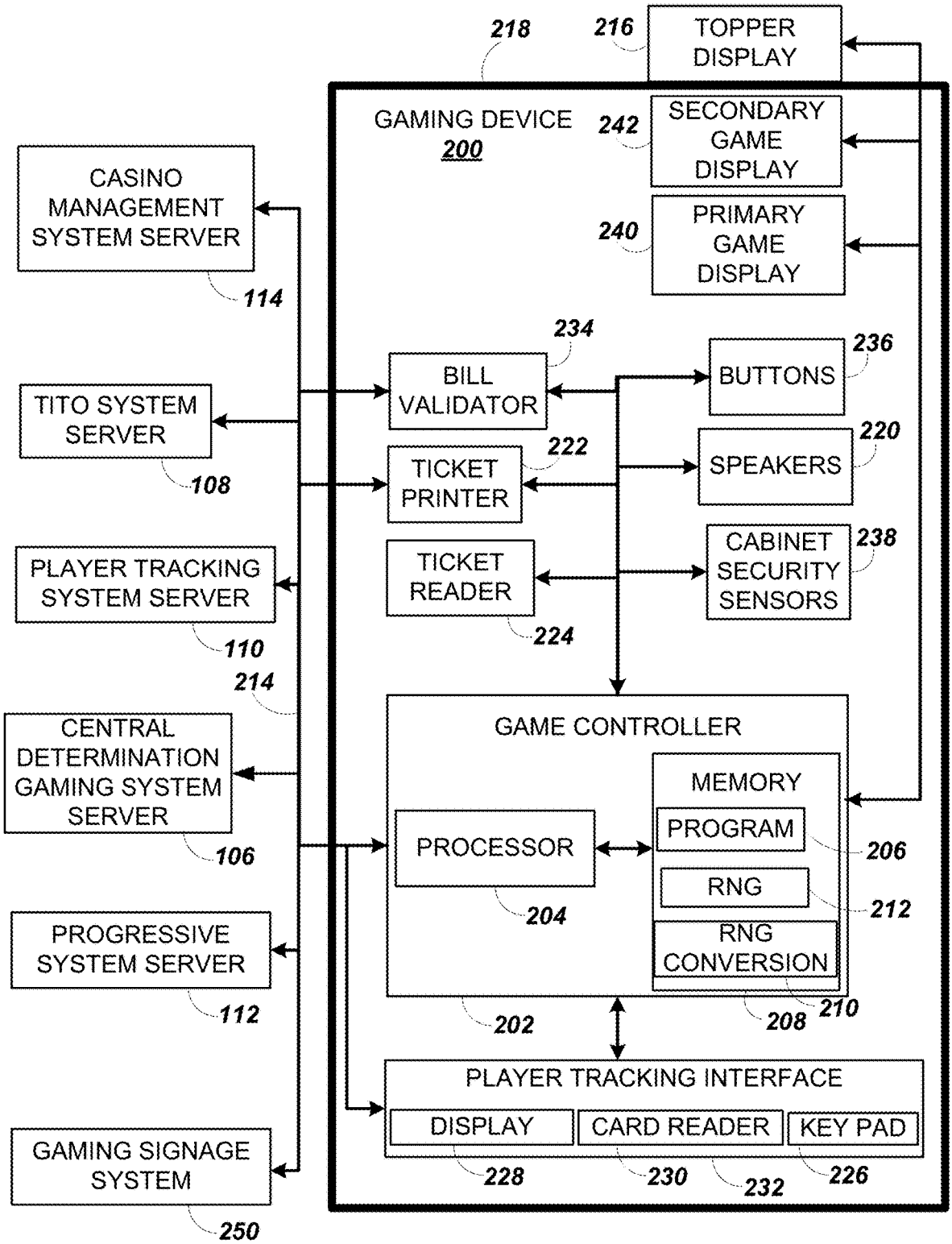
FIG. 2A is a block diagram showing various functional elements of an example EGM.

Many or all the above described components can be controlled by circuitry (e.g., a gaming controller) housed inside the main cabinet 116 of the gaming device 104A, the details of which are shown in FIG. 2A.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 154 which opens to provide access to the interior of the gaming device 104B. The main or service door 154 is typically used by service personnel to refill the ticket-out printer 126 and collect bills and tickets inserted into the bill validator 124. The main or service door 154 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2A is a block diagram depicting examples of internal electronic components of a gaming device 200 connected to various external systems. All or parts of the example gaming device 200 shown could be used to implement any one of the example gaming devices 104A-X depicted in FIG. 1. As shown in FIG. 2A, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2A also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2A illustrates that game controller 202 includes a single processor 204, game controller 202 is not limited to this representation and instead can include multiple processors 204 (e.g., two or more processors).

FIG. 2A illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2A illustrates that game controller 202 includes a single memory 208, game controller 208 could include multiple memories 208 for storing program instructions and/or data.

Memory 208 can store one or more game programs 206 that provide program instructions and/or data for carrying out various embodiments (e.g., game mechanics) described herein. Stated another way, game program 206 represents an executable program stored in any portion or component of memory 208. In one or more embodiments, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be setup to generate one or more game instances based on instructions and/or data that gaming device 200 exchange with one or more remote gaming devices, such as a central determination gaming system server 106 (not shown in FIG. 2A but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2A illustrates that gaming device 200 includes an RNG 212 that utilizes hardware and/or software to generate RNG outcomes that lack any pattern. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more embodiments, RNG 212 could be one of a set of RNGs operating on gaming device 200. Game developers could vary the degree of true randomness for each RNG (e.g., pseudorandom) and utilize specific RNGs depending on game requirements.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). FIG. 2A illustrates that gaming device 200 includes an RNG conversion engine 210 that translates the RNG outcome from RNG 212 to a game outcome presented to a player. To meet a designated RTP, a game developer can setup the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2A also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Although FIGS. 1 and 2A illustrates specific embodiments of a gaming device (e.g., gaming devices 104A-104X and 200), the disclosure is not limited to those embodiments shown in FIGS. 1 and 2A. For example, not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards. Additionally, or alternatively, gaming devices 104A-104X and 200 can include credit transceivers that wirelessly communicate (e.g., Bluetooth or other near-field communication technology) with one or more mobile devices to perform credit transactions. As an example, bill validator 234 could contain or be coupled to the credit transceiver that output credits from and/or load credits onto the gaming device 104A by communicating with a player's smartphone (e.g., a digital wallet interface). Gaming devices 104A-104X and 200 may also include other processors that are not separately shown. Using FIG. 2A as an example, gaming device 200 could include display controllers (not shown in FIG. 2A) configured to receive video input signals or instructions to display images on game displays 240 and 242. Alternatively, such display controllers may be integrated into the game controller 202. The use and discussion of FIGS. 1 and 2A are examples to facilitate ease of description and explanation.

Figure 2B:
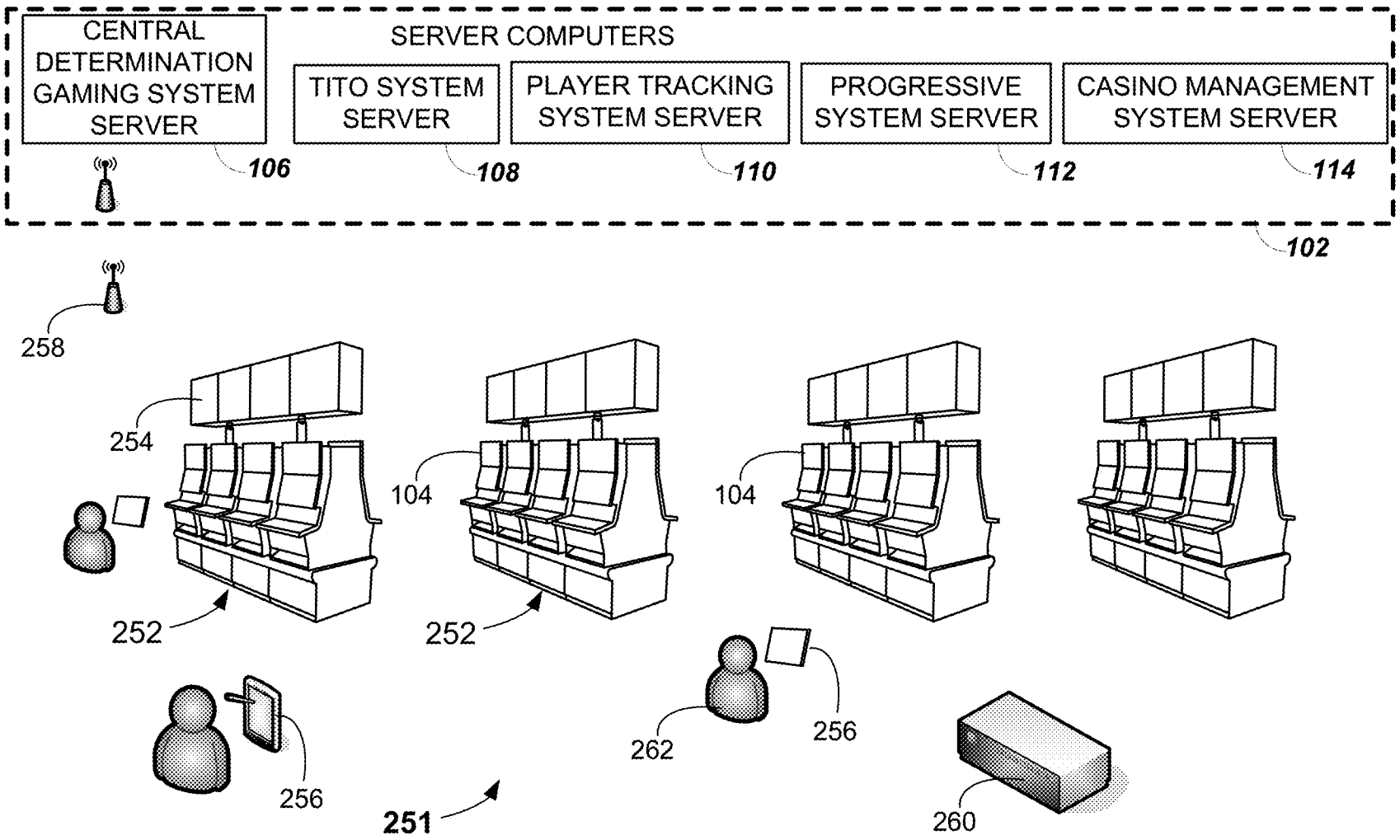
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254. According to this implementation, the casino 251 also includes mobile gaming devices 256, which are also configured to present wagering games in this example. The mobile gaming devices 256 may, for example, include tablet devices, cellular phones, smart phones and/or other handheld devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor(s) to verify the identity of an authorized patron. Some mobile gaming devices 256 may be configured to function only within a predetermined or configurable area, such as a casino gaming area.

Figure 2C:
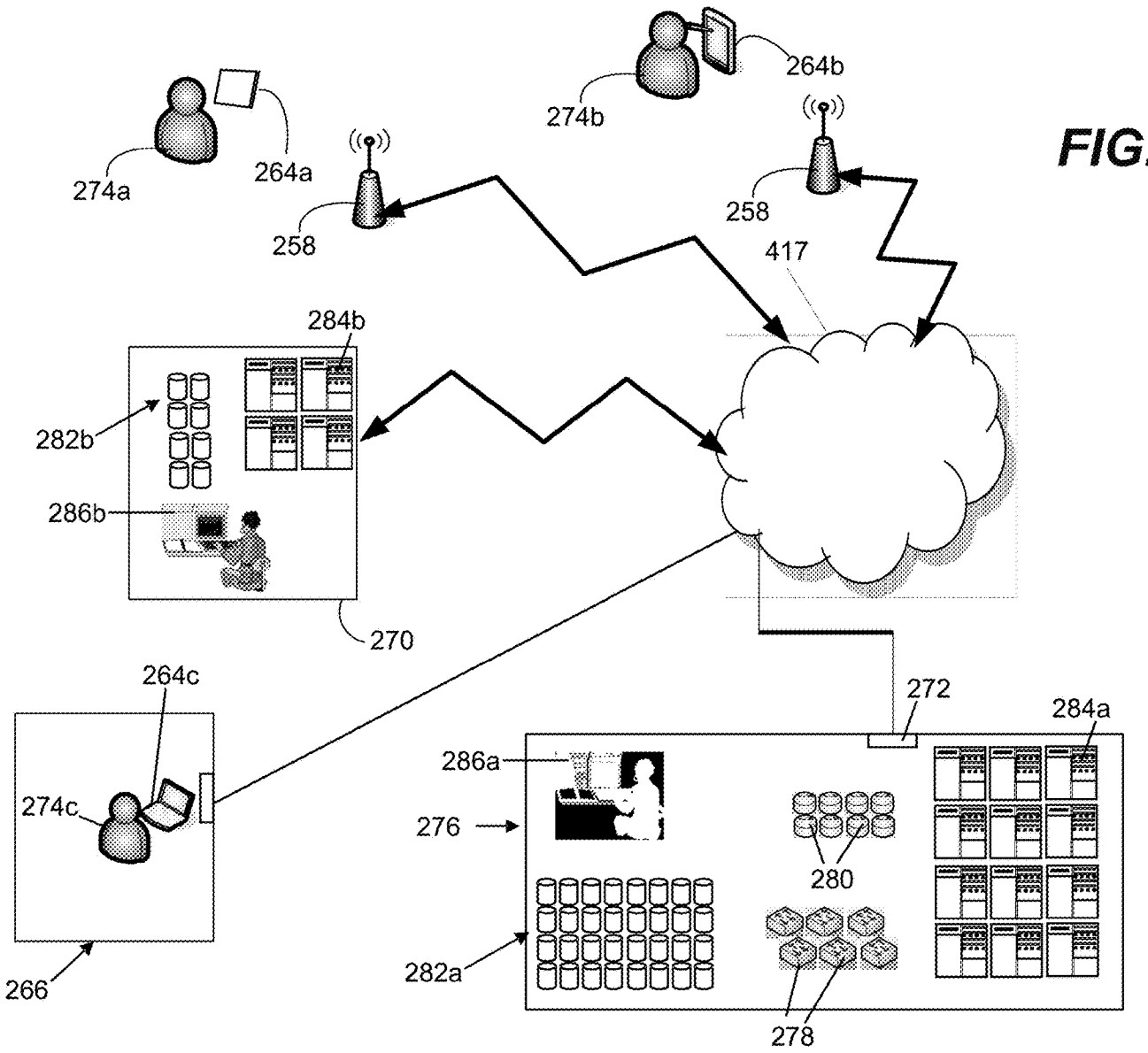
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server(s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such as EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3:
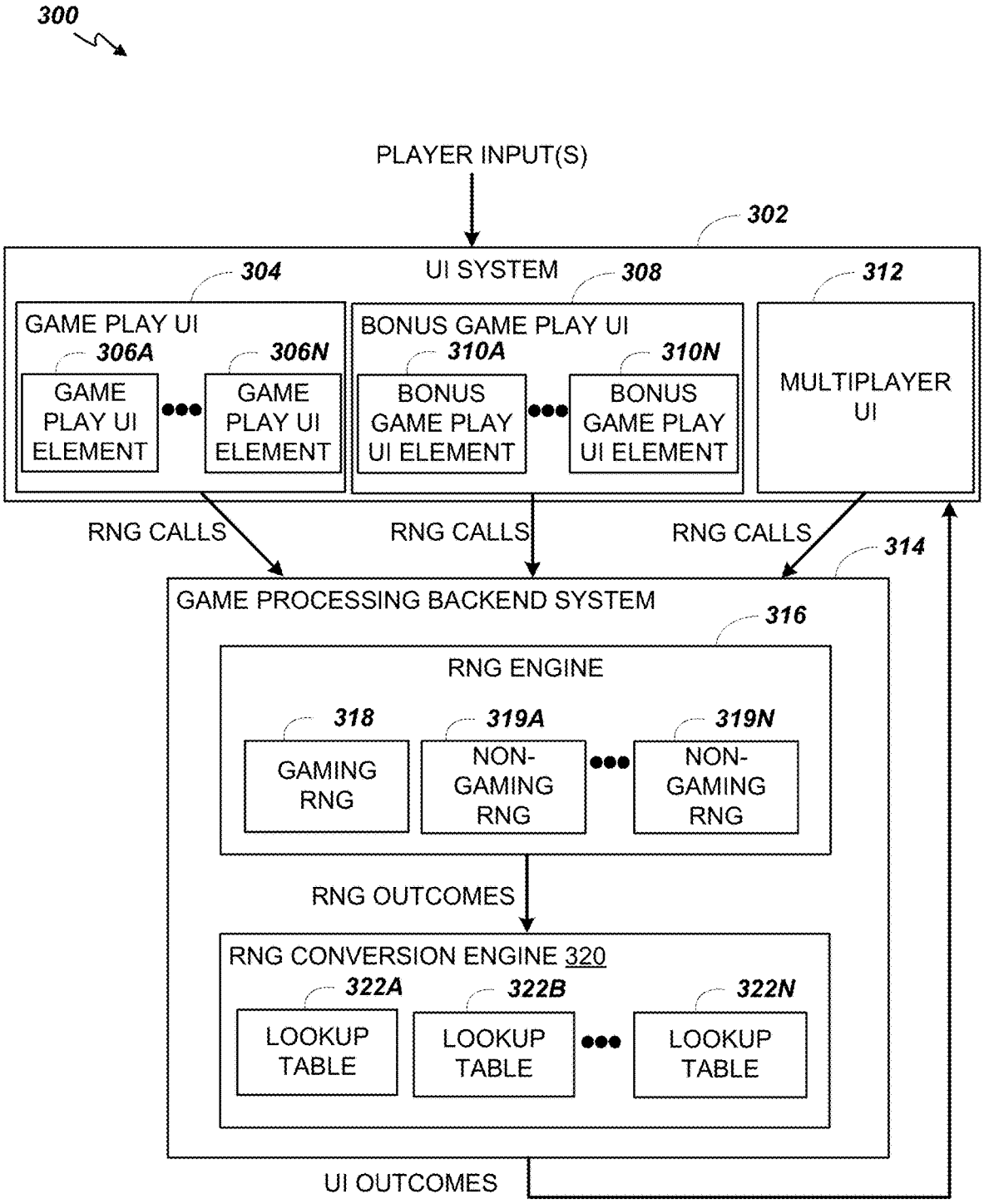
FIG. 3 illustrates, in block diagram form, an embodiment of a game processing architecture that implements a game processing pipeline for the play of a game in accordance with various embodiments described herein.

FIG. 3 illustrates, in block diagram form, an embodiment of a game processing architecture 300 that implements a game processing pipeline for the play of a game in accordance with various embodiments described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes for the UI system 302 to display to a player. The game processing architecture 300 can implement the game processing pipeline using a gaming device, such as gaming devices 104A-104X and 200 shown in FIGS. 1 and 2A, respectively. Alternatively, portions of the gaming processing architecture 300 can implement the game processing pipeline using a gaming device and one or more remote gaming devices, such as central determination gaming system server 106 shown in FIG. 1. In some such examples, the game processing pipeline may include a gaming device and one or more servers 284*a* of the gaming data center 276 shown in FIG. 2C. According to some such implementations, the gaming device may be a mobile device such as described above with reference to FIG. 2B or an EUD as described above with reference to FIG. 2C.

The UI system 302 includes one or more UIs that a player can interact with. The UI system 302 could include one or more game play UIs 304, one or more bonus game play UIs 304, and one or more multiplayer UIs 306, where each UI type includes one or more mechanical UIs and/or graphical UIs (GUIs). In other words, game play UI 304, bonus game play UI 304, and the multiplayer UI 304 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more embodiments, at least some of the game play UI element 306A-306N are similar to the bonus game play UI elements 310A-310N. In other embodiments, the game play UI element 306A-306N can differ from to the bonus game play UI elements 310A-310N.

FIG. 3 also illustrates that UI system 302 could include a multiplayer UI 312 purposed for game play that differ or is separate from the typical base game. For example, multiplayer UI 302 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 corresponds to RNG 212 shown in FIG. 2. As previously discussed with reference to FIG. 2, gaming RNG 318 often performs specialized and non-generic operations that comply with regulatory and/or game requirements. For example, because of regulation requirements, gaming RNG 318 could be a cryptographic random or pseudorandom number generator (PRNG) (e.g., Fortuna PRNG) that securely produces random numbers for one or more game features. To generate random numbers, gaming RNG 318 could collect random data from various sources of entropy, such as from an operating system (OS). Alternatively, non-gaming RNGs 319A-319N may not be cryptographically secure and/or be computational less expensive. Non-gaming RNGS 319A-319N can, thus, be used to generate outcomes for non-gaming purposes. As an example, non-gaming RNGs 319A-319N can generate random numbers for such as generating random messages that appear on the gaming device. The RNG conversion engine 320 processes each RNG outcome from RNG engine 316 and converts the RNG outcome to a UI outcome that is feedback to the UI system 302. With reference to FIG. 2, RNG conversion engine 320 corresponds to RNG conversion engine 210 used for game play. As previously described, RNG conversion engine 320 translates the RNG outcome from the RNG 212 to a game outcome presented to a player. RNG conversion engine 320 utilizes one or more lookup tables 322A-322N to regulate a prize payout amount for each RNG outcome and how often the gaming device pays out the derived prize payout amounts. In one example, the RNG conversion engine 320 could utilize one lookup table to map the RNG outcome to a game outcome displayed to a player and a second lookup table as a pay table for determining the prize payout amount for each game outcome. In this example, the mapping between the RNG outcome to the game outcome controls the frequency in hitting certain prize payout amounts. Different lookup tables could be utilized depending on the different game modes, for example, a base game versus a bonus game.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to the updating the appropriate UI, the player may subsequently provide additional player inputs to initiate a subsequent game instance that progresses through the game processing pipeline.

FIG. 3 shows examples of lookup tables 322A . . . 322N, which are also called weighted tables. In general, a weighted table can be implemented as any data structure that assigns probabilities to different options, in order for one of the different options to be selected using a random number. Different options are represented in different entries of a weighted table. The probabilities for different options can be reflected in threshold values (e.g., 1<RND<=40 for option 1, 40<RND<=70 for option 2, 70<RND<=90 for option 3, and 90<RND<=100 for option 4, given four options and a random number (RND) where 0<RND<=100). The threshold values can represent percentages or, more generally, sub-ranges within the range for a random number. In some example implementations, the threshold values for a weighted table are represented as count values for the respective entries of the weighted table. For example, the following table shows count values for the four options described above:

TABLE 1

Example Weighted Table

| count value | entry |
|---|---|
| 40 | <value a1, value a2, . . . > |
| 30 | <value b1, value b2, . . . > |
| 20 | <value c1, value c2, . . . > |
| 10 | <value d1, value d2, . . . > |

The sum total of the count values indicates the range of the options. Control logic can use a random number, generated between 1 and the sum total of the count values, to select one of the entries in the weighted table by comparing the random number to successive running totals. In the example shown in Table 1, if the random number is 40 or less, the first entry is selected. Otherwise, if the random number is between 41 and 70, the second entry is selected. Otherwise, if the random number is between 71 and 90, the third entry is selected. Otherwise, the last entry is selected.

The threshold values for a weighted table can be fixed and pre-determined. Or, the threshold values for a weighted table can vary dynamically (e.g., depending on bet level). Or, a weighted table can be dynamically selected (e.g., depending on bet level) from among multiple available weighted tables. Different parameters or choices during game play can use different weighted tables. Or, different combinations of parameters or choices can be combined in entries of a given weighted table.

According to some examples, the example game processing architecture 300 shown in FIG. 3 can be used to process game play instructions and generate outcomes as shown and described herein. In response to user input received via an interface system for initiation of an instance of a wagering game (e.g., an indication of user input from a "play" button), the game play UI 304 may make one or more RNG calls to the game processing backend system 314 for determining a game outcome and corresponding display symbols for the instance of the wagering game. According to some examples, the wagering game may be a slot game.

In some instances, the one or more RNG calls may include an RNG call to determine whether a game outcome presentation will involve displaying a persistent moving symbol and, if so, in which display symbol position the persistent moving symbol will be presented. In some such examples, there may be at least one RNG call involving whether a persistent moving symbol will be presented in one or more display symbol locations that is separate from the RNG call(s) for determining whether one or more wild symbols will be presented adjacent to the initial persistent moving symbol position. According to some implementations, the one or more RNG calls for determining the game outcome and corresponding display symbols for the instance of the wagering game may include an RNG call to determine whether one or more wild symbols that may be presented adjacent to the initial persistent moving symbol position will be part of a winning combination of display symbols.

In response, the backend system 314 may perform various operations. Using a gaming RNG 318, the RNG engine 316 may generate one or more random numbers, which may be passed to the RNG conversion engine 320. The RNG conversion engine 320 may use the one or more random numbers (along with one or more of the lookup tables 322A-322N) to determine symbol stop positions for the active reels. The RNG conversion engine 320 may use one or more other random numbers (along with one or more of the lookup tables 322A-322N) to determine whether a game outcome presentation will involve displaying a persistent moving symbol and, if so, in which display symbol position the persistent moving symbol will be presented, as well as whether one or more wild symbols will be presented adjacent to the initial persistent moving symbol position and the arrangement of the wild symbols, if any. The backend system 314 may also determine the outcome of the process (e.g., calculating whether any win conditions exist on pay lines, etc.

Figure 4:
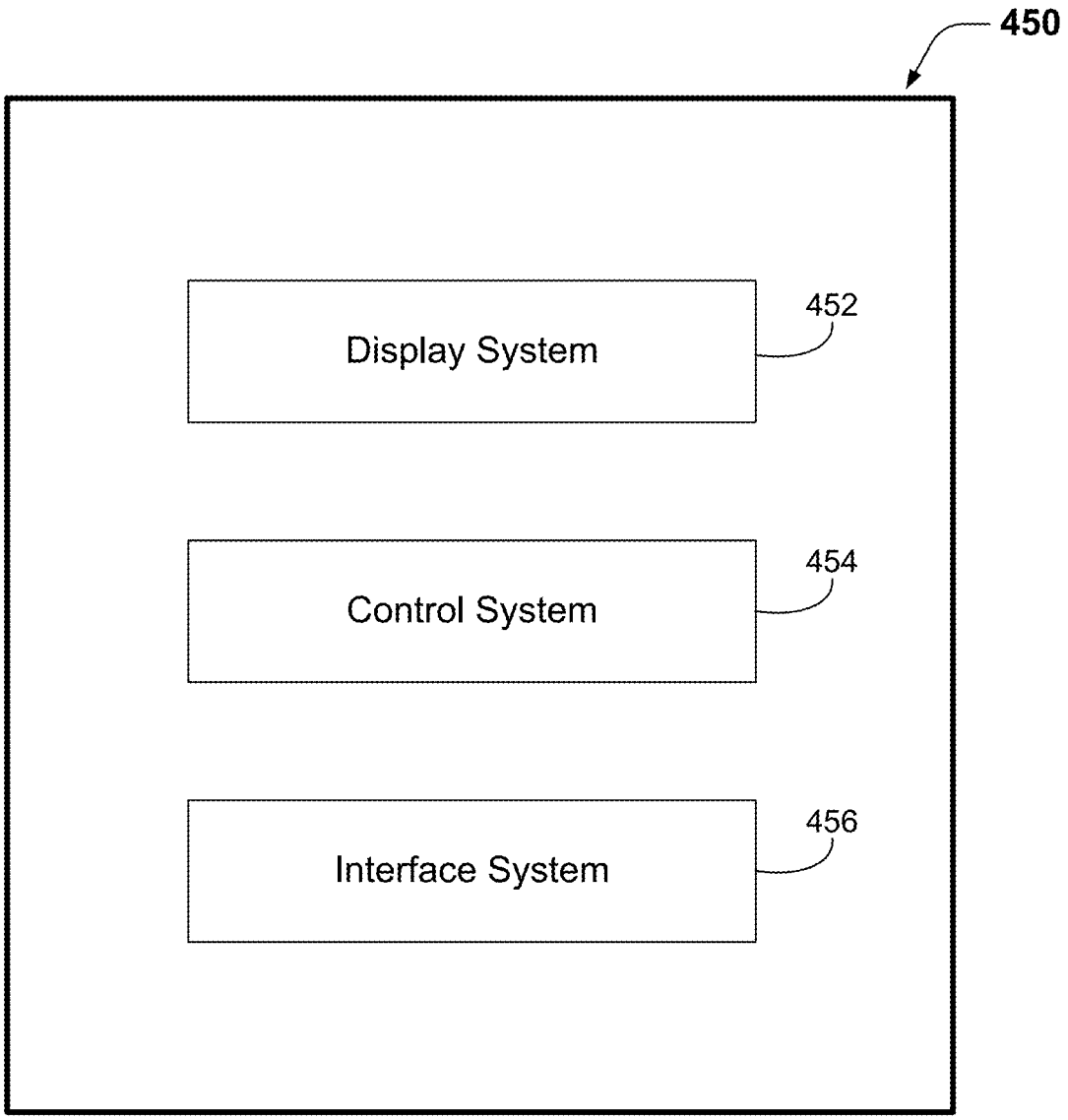
FIG. 4 is a block diagram that shows blocks of an apparatus according to one example.

FIG. 4 is a block diagram that shows blocks of an apparatus according to one example. According to some examples, the apparatus 450 may be, or may include, a gaming device. In some examples, the apparatus 450 may be an EGM such as those described above with reference to FIGS. 1 and 2A. However, in alternative examples, the apparatus 450 may be a mobile device such as described above with reference to FIG. 2B or an EUD as described above with reference to FIG. 2C.

In this example, the apparatus 450 includes a display system 452 and a control system 454 that is configured to communicate with the display system 452. In this example, the control system 454 is configured to communicate with the display system 452 via wired communication, e.g., via electrical signals. In alternative implementations, the control system 454 may be configured to communicate with the display system 452 via wireless communication. Accordingly, at least a portion of the control system 454 may be coupled to the display system 452. As used herein, the term "coupled to" has a meaning that could include being physically coupled for wired communication or being configured for wireless communication.

The control system 454 may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. Although the interface system 456 is shown as being separate from the control system 454, in some implementations the interface system 456 may be part of the control system 454. In some implementations, the interface system 456 may include the entire control system 454. The control system 454 also may include (and/or be configured for communication with) one or more memory devices, such as one or more random access memory (RAM) devices, read-only memory (ROM) devices and/or other types of non-transitory media. In some implementations, at least a portion of the control system 454 may be implemented as a register. Accordingly, the apparatus 450 may have a memory system that includes one or more memory devices, though the memory system is not shown in FIG. 4.

The control system 454 may be capable of performing, at least in part, the methods disclosed herein. In some examples, the control system 454 may be capable of performing at least some of the methods described herein according to instructions (e.g., software) stored on one or more non-transitory media. For example, the control system 454 may be configured for controlling the display system 452 and/or for receiving and processing data from at least a portion of the display system 452, e.g., as described below.

The display system 452 may include, one or more liquid crystal displays (LCDs), plasma displays, light-emitting diode (LED) displays, microLED displays or organic light-emitting diode (OLED) displays. According to some implementations, the display system 452 may include at least one flexible display, such as a flexible OLED. Although shown as separate components in FIG. 4, the display system 452 may, in some examples, include at least a portion of the control system 454. For example, the display system 452 may include one or more processors, microprocessors, programmable logic devices, discrete gates or transistor logic, etc.

In the example shown in FIG. 4, the apparatus 450 includes an interface system 456. In some examples, the interface system may include a wireless interface system. In some implementations, the interface system 456 may include a network interface, an interface between the control system 454 and the display system 452, an interface between the control system 454 and a memory system and/or an interface between the control system 454 and an external device interface (e.g., a port or an applications processor). In some examples, the interface system 456 may include one or more user interfaces, such as a touch screen, one or more buttons, a gesture recognition system, a voice recognition system, etc.

According to some implementations, the apparatus 450 may be a single device, whereas in other implementations the apparatus 450 may be a system that includes more than one device. Accordingly, the terms "apparatus" and "system" may sometimes be used interchangeably herein. In other examples, the apparatus 450 may be a component of another device. For example, in some implementations at least a portion of the display system 452 and/or the control system 454 may be included in more than one apparatus. For example, in some implementations at least part of the control system 454 may reside in a server, such as a central determination server or a gaming data center server. Some implementations of the apparatus 450 may not include a display system. In some such implementations, the control system 454 may be configured for controlling the display system of another device.

Figure 5:
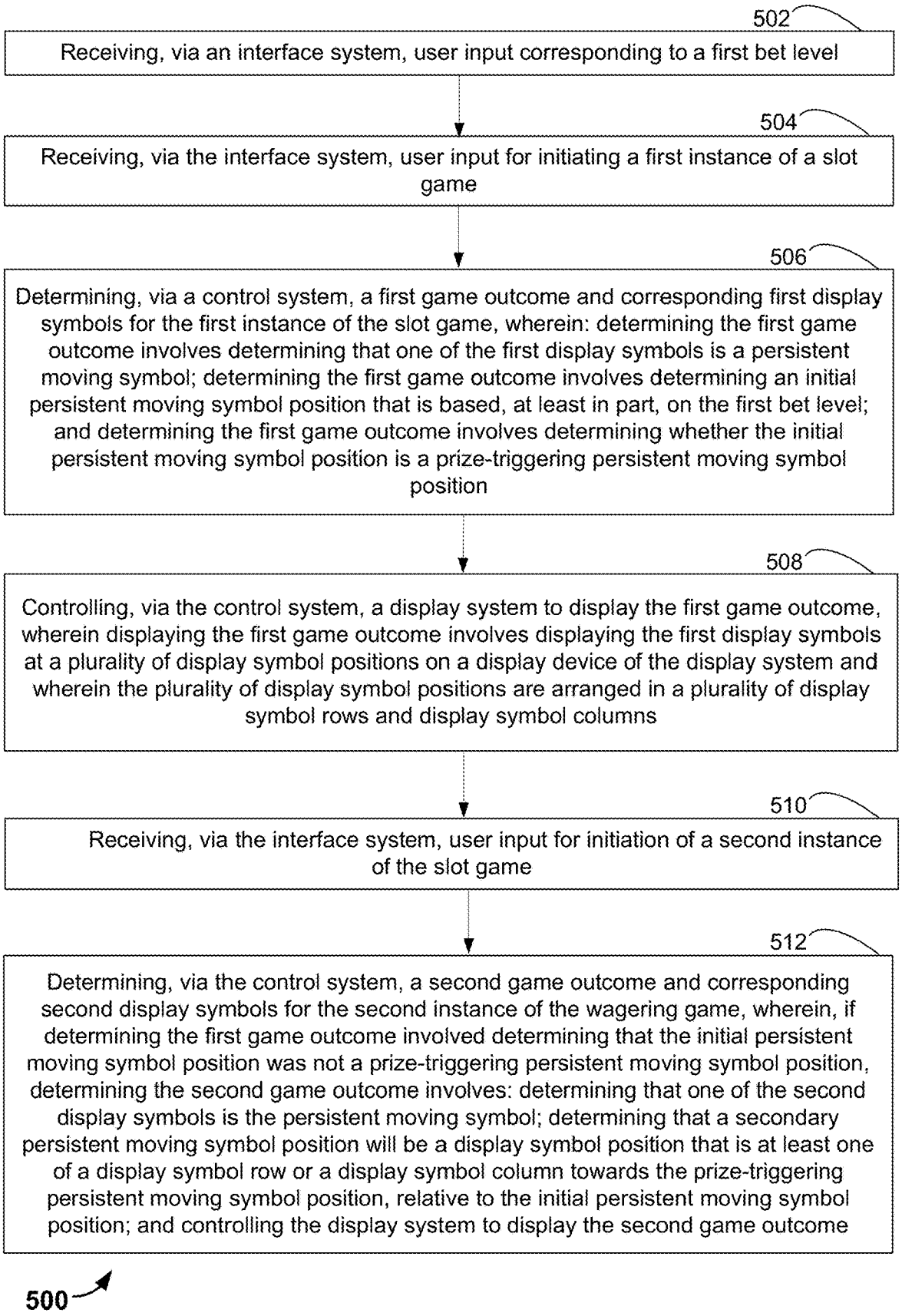
FIG. 5 is a flow diagram that shows blocks of a method according to one example.

FIG. 5 is a flow diagram that shows blocks of a method according to one example. In some examples method 500 may be performed, at least in part, by an apparatus such as that described above with reference to FIG. 4. In some examples, the method 500 may be performed, at least in part, by a control system (e.g., the control system 454 of FIG. 4) according to software stored upon one or more non-transitory storage media. According to some examples the method 500 may be performed, at least in part, by a server, such as a central determination server or a gaming data center server.

As with other methods described herein, the number and sequence of blocks shown in FIG. 5 are merely examples. Similar disclosed methods may include more or fewer blocks. Moreover, at least some of the blocks may occur in a different sequence than the sequence that is shown in a flow diagram. In some examples, operations corresponding to at least some of the blocks may be performed concurrently.

According to this example, block 502 involves receiving, via an interface system, user input corresponding to a first bet level. The interface system may, in some instances, include at least one user interface. The interface system may, in some instances, include at least one network interface. In this example, block 504 involves receiving, via the interface system, user input for initiation of a first instance of a slot game. For example, the user input may be received by the control system 454 of FIG. 4, via a user interface of the interface system 456.

Block 502 may, for example, involve receiving an indication that a user has pressed a button to select the first bet level, has provided input to an area of a graphical user interface (GUI) for selecting a wager level (e.g., via a touch screen, a touch pad, a mouse, etc.). Block 504 may, for example, involve receiving an indication that a user has pressed a "play" button of a gaming device, receiving an indication that the user has touched an area of a touch screen that corresponds to a displayed image of a "play" button, etc. In some such implementations, block 502, block 504 or a preceding block of method 500 may involve verifying that there is sufficient credit for at least one instance of a game. According to some such implementations, the method 500 may be performed by a gaming device that includes apparatus for receiving monetary credit.

Figure 6:
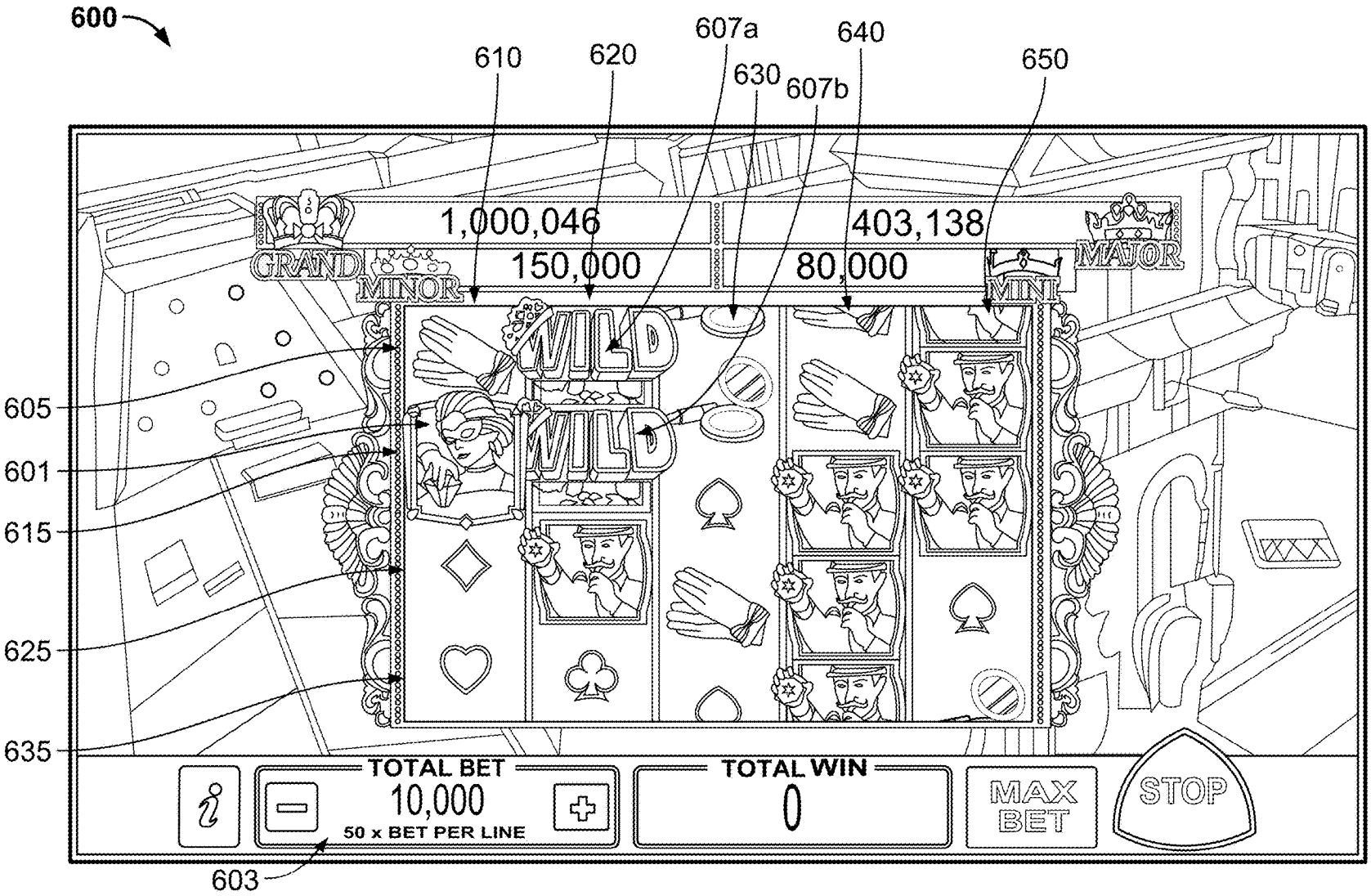
FIG. 6 shows an example of a display that may be presented according to one implementation of the method of FIG. 5.

According to this implementation, block 506 involves determining, via a control system, a first game outcome and corresponding first display symbols for the instance of the wagering game. In some examples of method 500, determining the first game outcome involves determining whether one of the first display symbols is a persistent moving symbol. Examples of persistent moving symbols are shown in FIG. 6 et seq. and are described below.

According to some such examples, determining whether one of the first display symbols is a persistent moving symbol may involve making a random number generator (RNG) call to a game processing backend system. In some instances, the RNG call may be made by the UI system 302 that is described above with reference to FIG. 3. In some such examples, determining whether one of the first display symbols is a persistent moving symbol may involve determining an RNG outcome based on the RNG call and providing the RNG outcome to an RNG conversion engine. The RNG conversion engine may refer to one or more lookup tables, which may include one or more weighted lookup tables, in order to determine whether one of the first display symbols is a persistent moving symbol.

According to some such examples, both the UI system 302 and the game processing backend system 314 that are described above with reference to FIG. 3 may reside in a single gaming device. In other examples, the determination of block 506 may be made, at least in part, by a server. According to some such examples, the server may determine both the slot game outcome and the corresponding display symbols. According to some such examples, both the UI system 302 and the game processing backend system 314 may reside in a single device, such as a single server. In some examples, one device (e.g., a server) may determine at least a portion of the slot game outcome (e.g., a particular number of credits to be awarded) and another device (e.g., a local gaming device on which a game is being presented) may determine the display symbols corresponding to the outcome obtained from the server. In some such examples, the UI system 302 may reside in one device and the game processing backend system 314 may reside in another device. According to some alternative examples, one server may implement at least a portion of the UI system 302 and another server may implement the game processing backend system 314.

In this example, block 506 involves determining that one of the first display symbols is a persistent moving symbol. According to this example, block 506 involves determining an initial persistent moving symbol position that is based, at least in part, on the first bet level. In this example, block 506 involves determining whether the initial persistent moving symbol position is a prize-triggering persistent moving symbol position.

The initial persistent moving symbol position and/or the prize-triggering persistent moving symbol position may, in some examples, be predetermined display symbol locations. A predetermined display symbol location may, in some examples, be one of the display symbol locations of a predetermined display symbol column and/or one of the display symbol locations of a predetermined display symbol row. According to some such implementations, the initial persistent moving symbol position and/or the prize-triggering persistent moving symbol position will only be in a predetermined display symbol column and/or a predetermined display symbol row. For example, the initial persistent moving symbol position may be an initial display symbol row and an initial display symbol column. The initial display symbol column may, in some instances, correspond to the first bet level. However, in alternative examples the initial persistent moving symbol position and/or the prize-triggering persistent moving symbol position may be any display symbol location.

In this example, block 508 involves controlling, via the control system, a display system to display the first game outcome, wherein displaying the first game outcome involves displaying the first display symbols at a plurality of display symbol positions on a display device of the display system and wherein the plurality of display symbol positions are arranged in a plurality of display symbol rows and display symbol columns.

According to the example shown in FIG. 5, block 510 involves receiving, via the interface system, user input for initiation of a second instance of the slot game. In this example, block 512 involves determining, via the control system, a second game outcome and corresponding second display symbols for the second instance of the wagering game.

In this implementation, block 512 depends on whether the initial persistent moving symbol position was a prize-triggering persistent moving symbol position. According to this example, if it was determined in block 506 that the initial persistent moving symbol position was not a prize-triggering persistent moving symbol position, determining the second game outcome involves determining that one of the second display symbols is the persistent moving symbol. In other words, according to some such implementations if the game outcome for the previous game instance included an initial persistent moving symbol position that was not a prize-triggering persistent moving symbol position, the outcome for the current game instance would always include a persistent moving symbol.

According to some such examples, a secondary persistent moving symbol position will be closer to the prize-triggering persistent moving symbol position than the initial persistent moving symbol position. In some such implementations, block 512 will involve determining that a secondary persistent moving symbol position will be a display symbol position that is at least one display symbol row or display symbol column towards the prize-triggering persistent moving symbol position, relative to the initial persistent moving symbol position.

In some examples, if the game outcome for the previous game instance included an initial persistent moving symbol position that was not a prize-triggering persistent moving symbol position, the secondary persistent moving symbol position is predetermined. According to some such examples, the secondary persistent moving symbol position may always be adjacent to the initial persistent moving symbol position. In some such examples, the secondary persistent moving symbol position may always be in the same row as the initial persistent moving symbol position but one column closer to a prize-triggering persistent moving symbol position, or in the same column as the initial persistent moving symbol position but one row closer to a prize-triggering persistent moving symbol position. Such examples have a potential technical advantage, because fewer RNG calls will be required to determine the outcome of the second game instance.

In some implementations, if the initial persistent moving symbol position is not the prize-triggering persistent moving symbol position, the control system may be configured to award a multiplier at a display symbol position between the initial persistent moving symbol position and the prize-triggering persistent moving symbol position. In some instances, the multiplier may apply to any winning outcome that includes the persistent moving symbol. The multiplier may, for example, be a 2× multiplier, a 3× multiplier, a 4× multiplier, a 5× multiplier, etc. The multiplier may, in some examples, persist for more than one game instance.

According to this example, block 512 involves controlling the display system to display the second game outcome. Various examples are shown in FIG. 6 et seq. and are described below.

FIG. 6 shows an example of a display that may be presented according to one implementation of the method of FIG. 5. As with other implementations provided herein, the particular types of elements and the particular arrangement of elements shown in FIG. 6 are merely examples.

In this example, the display 600 is an example of a GUI that may be used to present instances of a "cat burglar"-themed wagering game. In some instances, the display 600 may be used to present an online wagering game, e.g., on an end user device (EUD) such as one of the EUDs 264*a*, 264*b* or 264*c* shown in FIG. 2C and described above. However, in alternative implementations the display 600 may be used to present a casino-based wagering game, e.g., on a gaming device such as one of the gaming devices 104A-104X that are shown in FIG. 1.

FIG. 6 shows one example of what may be referred to herein as a "first game outcome." As used herein, a "first game outcome" is not necessarily the first instance of gaming during a gaming session, but instead may be merely the first of two or more game outcomes in a sequence. For example, a player may initiate and play several game instances before the "first game outcome."

According to this example, displaying the game outcome shown in FIG. 6 involves displaying display symbols at a plurality of display symbol locations. In this implementation, the plurality of display symbol locations is arranged in display symbol rows 605-635 and display symbol columns 610-650. In the particular game outcome shown in FIG. 6, it was determined in block 506 that one of the first display symbols of the first game outcome would be a persistent moving symbol 601. In this example, the initial persistent moving symbol position is at column 610, row 615.

A prize-triggering persistent moving symbol position may be any of various display symbol locations, depending on the particular implementation. According to some implementations, the prize-triggering persistent moving symbol position may be in the same row or column as the initial persistent moving symbol position. In some such examples, the persistent moving symbol 601 may traverse one row and/or one column towards the prize-triggering persistent moving symbol position in each successive game instance. In some such examples, the persistent moving symbol 601 may remain in the same row or column as the persistent moving symbol 601 moves towards the prize-triggering persistent moving symbol position. In alternative implementations, the persistent moving symbol 601 may move along a diagonal while on its path towards the prize-triggering persistent moving symbol position.

According to some alternative implementations, the persistent moving symbol 601 may not always traverse one row and/or one column towards the prize-triggering persistent moving symbol position in each successive game instance. In some such examples, the persistent moving symbol 601 may remain in the same position until a particular type of symbol lands adjacent to the persistent moving symbol 601. Some such examples are described below with reference to FIG. 19 et seq.

In the example shown in FIG. 6, the first game outcome includes wild symbols 607*a* and 607*b* that are presented adjacent to the initial persistent moving symbol position. In some such examples, the wild symbols that may be presented adjacent to the initial persistent moving symbol position are "exploding" wild symbols. In some instances, the control system may cause the display system to present a series of images in which the wild symbols suddenly enlarge and/or change position.

In some such implementations, determining the first game outcome may involve making a random number generator (RNG) call (e.g., to a game processing backend system) to determine whether one or more wild symbols will be presented adjacent to the initial persistent moving symbol position. In some such examples, an RNG outcome based on the RNG call may indicate that one or more wild symbols will be presented adjacent to the initial persistent moving symbol position. According to some such implementations, an RNG conversion engine may refer to a weighted lookup table in order to determine a display symbol position for each of the one or more wild symbols.

The bet meter 603 indicates a total bet of 10,000 credits, which is the lowest allowable wager in this example. In this example, the determination of whether one of the first display symbols of the first game outcome would be a persistent moving symbol is based, at least in part, on the bet level. According to this implementation, if it is determined a persistent moving symbol will be presented in the first game outcome presentation, the initial persistent moving symbol position is also based, at least in part, on the bet level.

As noted elsewhere herein, in some examples determining whether one of the first display symbols is a persistent moving symbol also may involve making a random number generator (RNG) call to a game processing backend system. In some instances, the RNG call may be made by the UI system 302 that is described above with reference to FIG. 3. In some such examples, determining whether one of the first display symbols is a persistent moving symbol may involve determining an RNG outcome based on the RNG call and providing the RNG outcome to an RNG conversion engine. The RNG conversion engine may refer to one or more lookup tables, which may include one or more weighted lookup tables, in order to determine whether one of the first display symbols is a persistent moving symbol.

FIG. 7 shows an example of a weighted table that may be used to determine whether a persistent moving symbol will be presented in a game outcome. In this example, the reels 1-5 that are referenced in columns 710 of the weighted table 700 correspond to the columns 610-650 that are shown in FIG. 6. According to this example, the rows 2 and 3 that are referenced in column 715 of the weighted table 700 correspond to the rows 615 and 625 that are shown in FIG. 6.

According to this example, the weighted table 700 is weighted according to the wager levels, which also may be referred to herein as a bet levels, indicated in columns 720-740. "Bet1" corresponds to the lowest bet level and "Bet5" corresponds to the highest bet level, which also may be referred to herein as a "Max Bet." A higher weighting value corresponds with a higher probability of any particular outcome referenced in the weighted table 700. Therefore, the weighting values are smallest for Bet1, larger for Bet2, etc., and are largest for Bet5.

In this instance, the display symbol positions corresponding to reel 5, row 2 and reel 5, row 3 are prize-triggering persistent moving symbol positions. Therefore, one may see that for each bet level, the outcome having the lowest probability is an outcome in which a persistent moving symbol will be presented in a prize-triggering persistent moving symbol position. One may also see that for each bet level, among the outcomes in which a persistent moving symbol will be presented, the outcome having the highest probability is one in which the persistent moving symbol will be presented in reel 2 and the outcome having the second-highest probability is one in which the persistent moving symbol will be presented in reel 1. The game outcome example that is shown in FIG. 6 corresponds to the latter case: in that example, the bet level corresponds to the lowest level, "Bet1," and the weight corresponding to the persistent moving symbol being presented in reel 1 is 40.

A persistent moving symbol may or may not be one of the symbols that is on the reels, depending on the particular implementation. In other words, a persistent moving symbol may or may not already be part of a set of available symbols that may be selected for a particular base game outcome. For each paid base game instance, a persistent moving symbol may have a chance of "dropping" (being presented) on a specific reel. The chance may be based on the bet level, e.g., as shown in the weighted table 700. In some implementations in which a persistent moving symbol is not one of the symbols that is on the reels, the control system may choose (e.g., from the weighted table 700) one of the following options: (1) do not drop the persistent moving symbol on the reels; (2) trigger random wild symbols, or (3) drop the persistent moving symbol on a specific reel and specific row. These options are shown in column 705 of the weighted table 700, with options not corresponding to presenting a persistent moving symbol having a corresponding reel zero in column 710 of the weighted table 700 and a corresponding row zero in column 715 of the weighted table 700. In some implementations, if a persistent moving symbol is one of the symbols on the reels (in other words, if a persistent moving symbol is already part of a set of available symbols that may be selected for a base game outcome), weighted table 700 is not used and a normal reel spin will occur.

Figure 8:
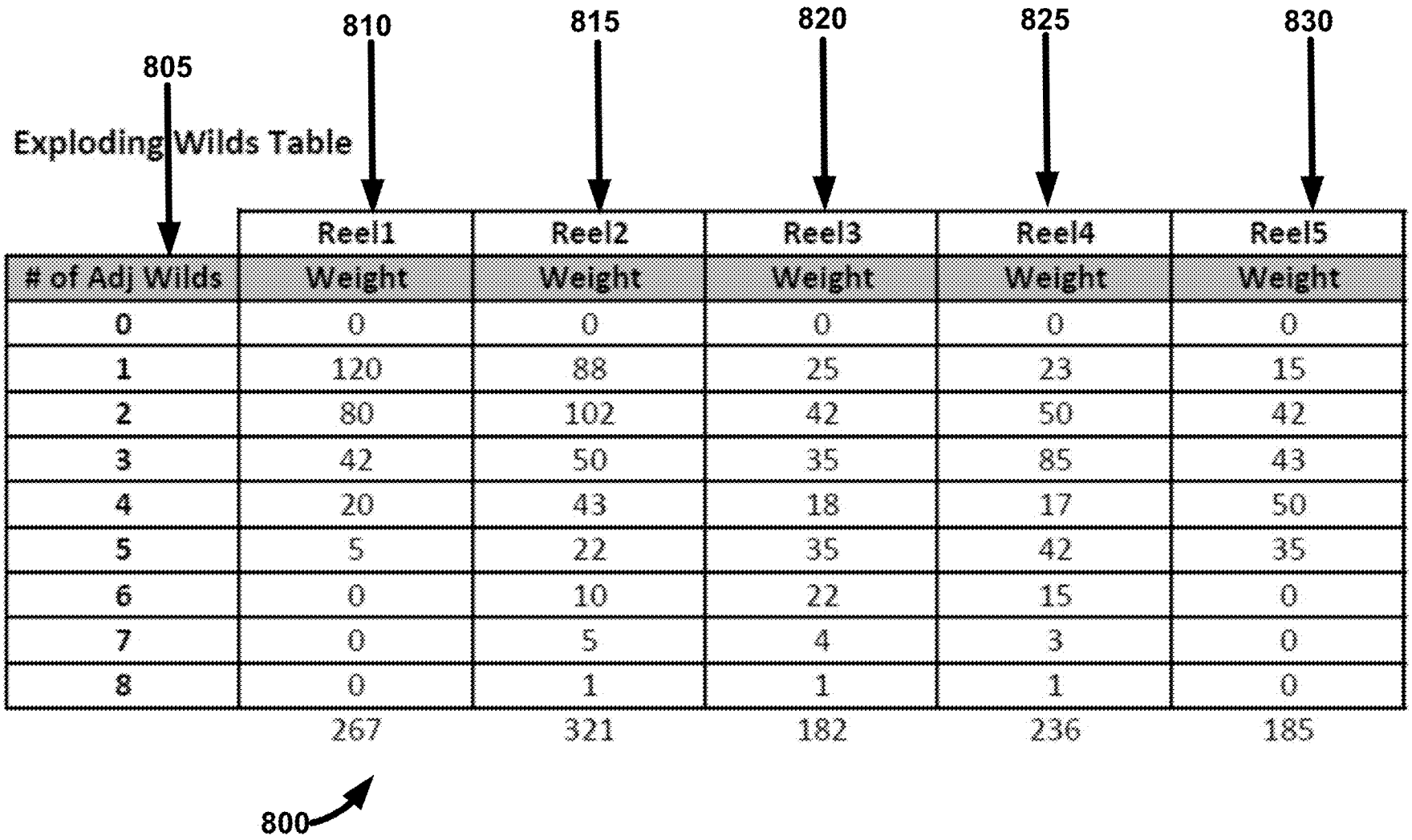
FIG. 8 shows an example of a weighted table that may be used to determine whether an exploding wild symbol will be presented adjacent to the persistent moving symbol in a game outcome and, if so, the number of exploding wild symbols that will be presented adjacent to the persistent moving symbol.

According to some implementations, when a persistent moving symbol is part of a game outcome, exploding wild symbols may be presented adjacent to the persistent moving symbol. FIG. 8 shows an example of a weighted table that may be used to determine whether an exploding wild symbol will be presented adjacent to the persistent moving symbol in a game outcome and, if so, the number of exploding wild symbols that will be presented adjacent to the persistent moving symbol. In this example, the reels 1-5 that are referenced in column 810-830 of the weighted table 800 correspond to the columns 610-650 that are shown in FIG. 6. According to this example, these reels correspond to the position of the persistent moving symbol.

In some implementations, based on the reel that the persistent moving symbol is on, the control system will refer to the weighted table 800 to determine how many (if any) exploding wild symbols will be presented adjacent to the persistent moving symbol. According to some such examples, the control system will randomly choose where to adjacently place the exploding wild symbols adjacent to the persistent moving symbol. In some such examples, the control will then stop the spinning reels and evaluate any wins. According to some examples, the persistent moving symbol and the exploded wild symbols may both function as wild symbols.

Figure 9:
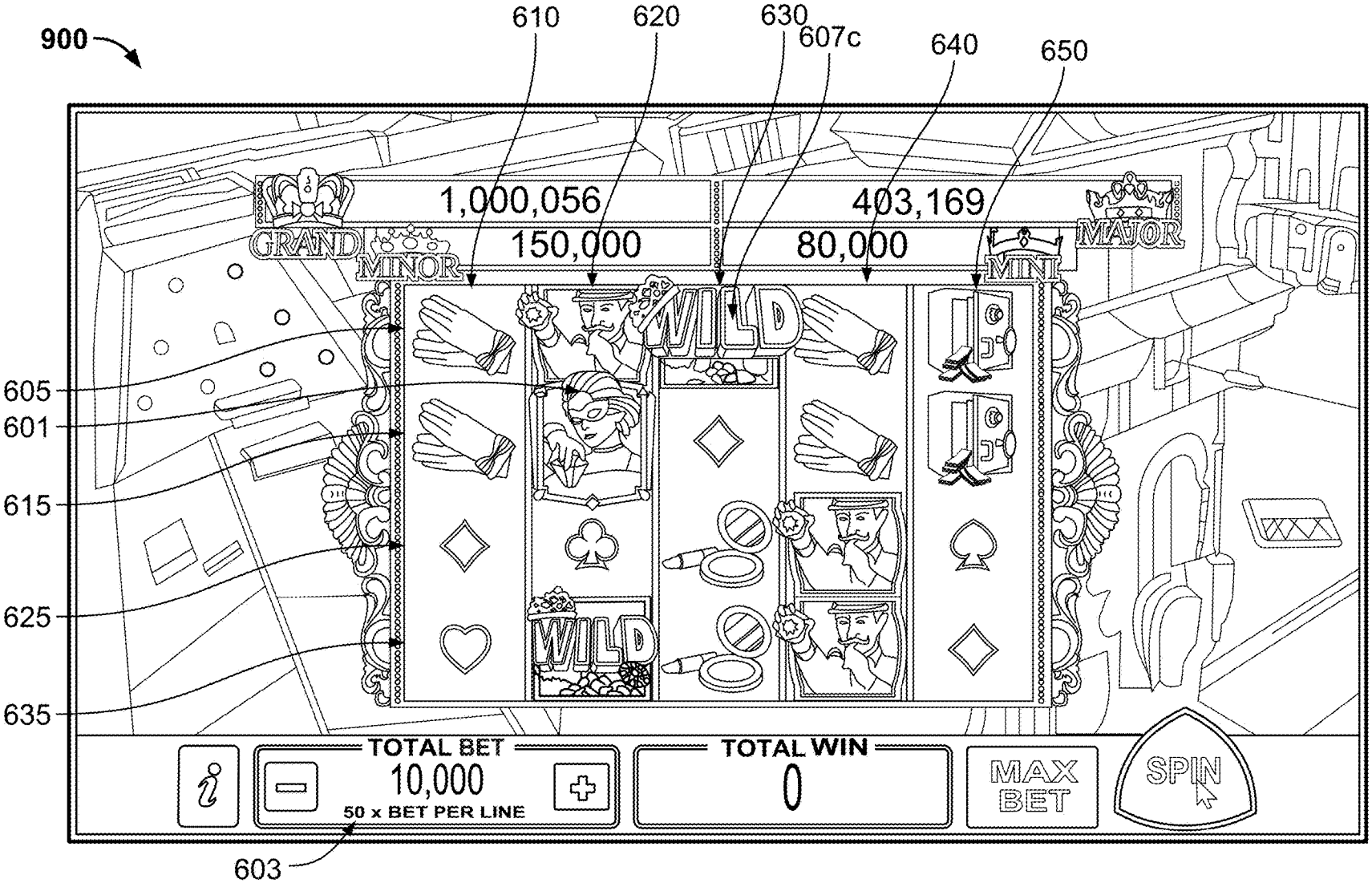
FIG. 9 shows an example of a display that may be presented after the display of FIG. 6 according to some examples.

FIG. 9 shows an example of a display that may be presented after the display of FIG. 6 according to some examples. According to this example, the display 900 is an example of a game outcome presentation that may be displayed during the next game instance after the game instance that is represented in FIG. 6. FIG. 9 shows an example of a game outcome presentation for what is referred to herein as a "second instance" of the slot game. A single exploding wild symbol (607*c*) is presented adjacent to the persistent moving symbol 601 in this example.

In this example, the persistent moving symbol 601 has remained in row 615, but has moved from column 610 to column 620. In this instance, the prize-triggering persistent moving symbol position is row 615, column 650. According to this example, the persistent moving symbol 601 will remain in the same row as the persistent moving symbol 601 moves towards the prize-triggering persistent moving symbol position. In this implementation, because the initial persistent moving symbol position was not a prize-triggering persistent moving symbol position, it was predetermined that one of the display symbols for the second instance of the slot game would be the persistent moving symbol. The secondary persistent moving symbol position was also predetermined according to this example: it was predetermined that the secondary persistent moving symbol position would be in the same row as the prize-triggering persistent moving symbol position, but one column closer to the prize-triggering persistent moving symbol position. Therefore, no RNG call was required to determine these aspects of the second game outcome.

Figure 10:
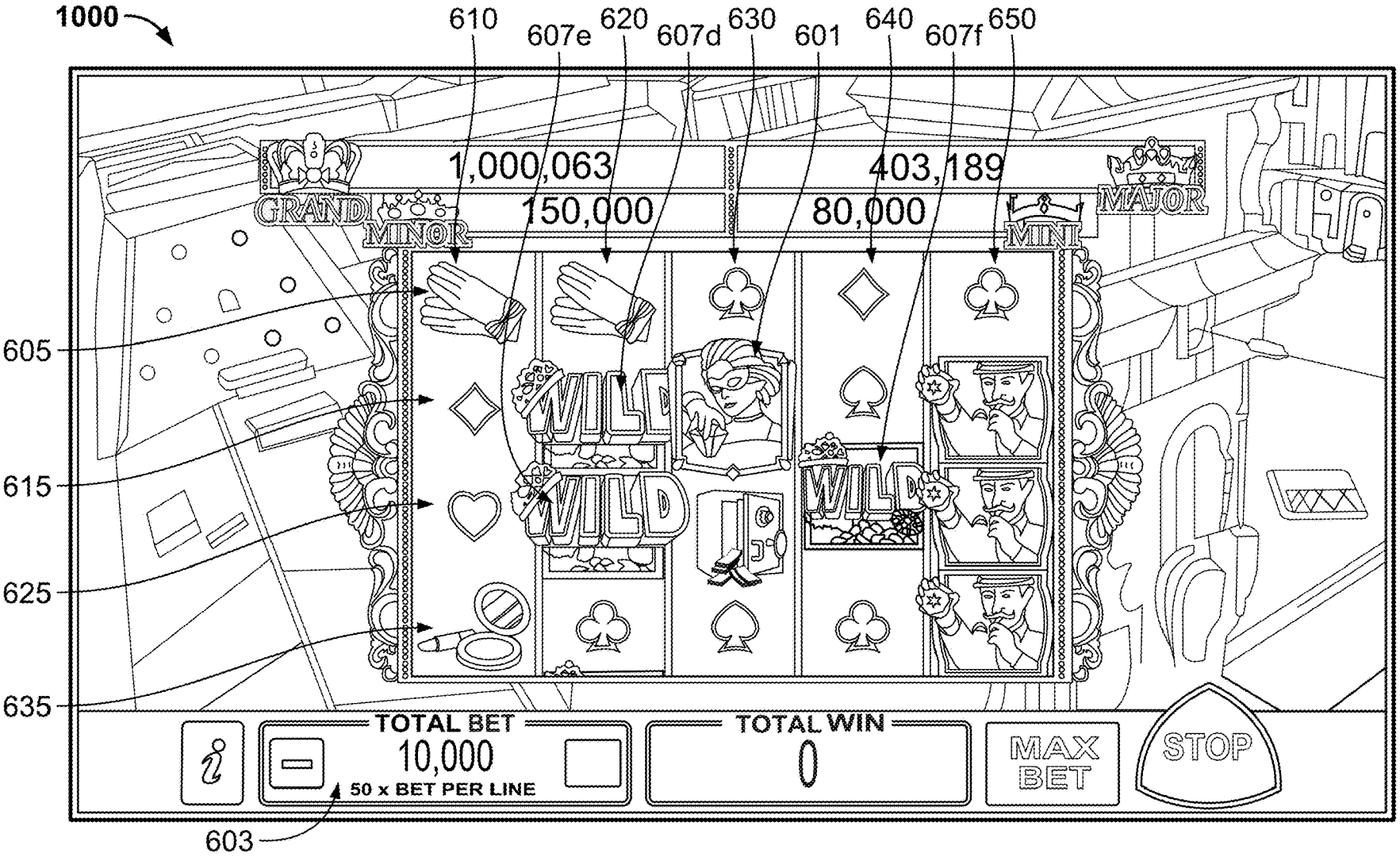
FIG. 10 shows an example of a display that may be presented after the display of FIG. 9 according to some examples.

FIG. 10 shows an example of a display that may be presented after the display of FIG. 9 according to some examples. According to this example, the display 1000 is an example of a game outcome presentation that may be displayed during the next game instance after the game instance that is represented in FIG. 9. FIG. 10 shows an example of a game outcome presentation for what may be referred to herein as a "third instance" of the slot game. Exploding wild symbols 607*d*, 607*e* and 607*f* are presented adjacent to the persistent moving symbol 601 in this example.

In this example, the persistent moving symbol 601 has remained in row 615, but has moved from column 620 to column 630. In this implementation, because the secondary persistent moving symbol position was not a prize-triggering persistent moving symbol position, it was predetermined that one of the display symbols for the third instance of the slot game would be the persistent moving symbol. The tertiary persistent moving symbol position was also predetermined according to this example: it was predetermined that the tertiary persistent moving symbol position would be in the same row as the prize-triggering persistent moving symbol position, but one column closer to the prize-triggering persistent moving symbol position. Therefore, no RNG call was required to determine these aspects of the third game outcome.

Figure 11:
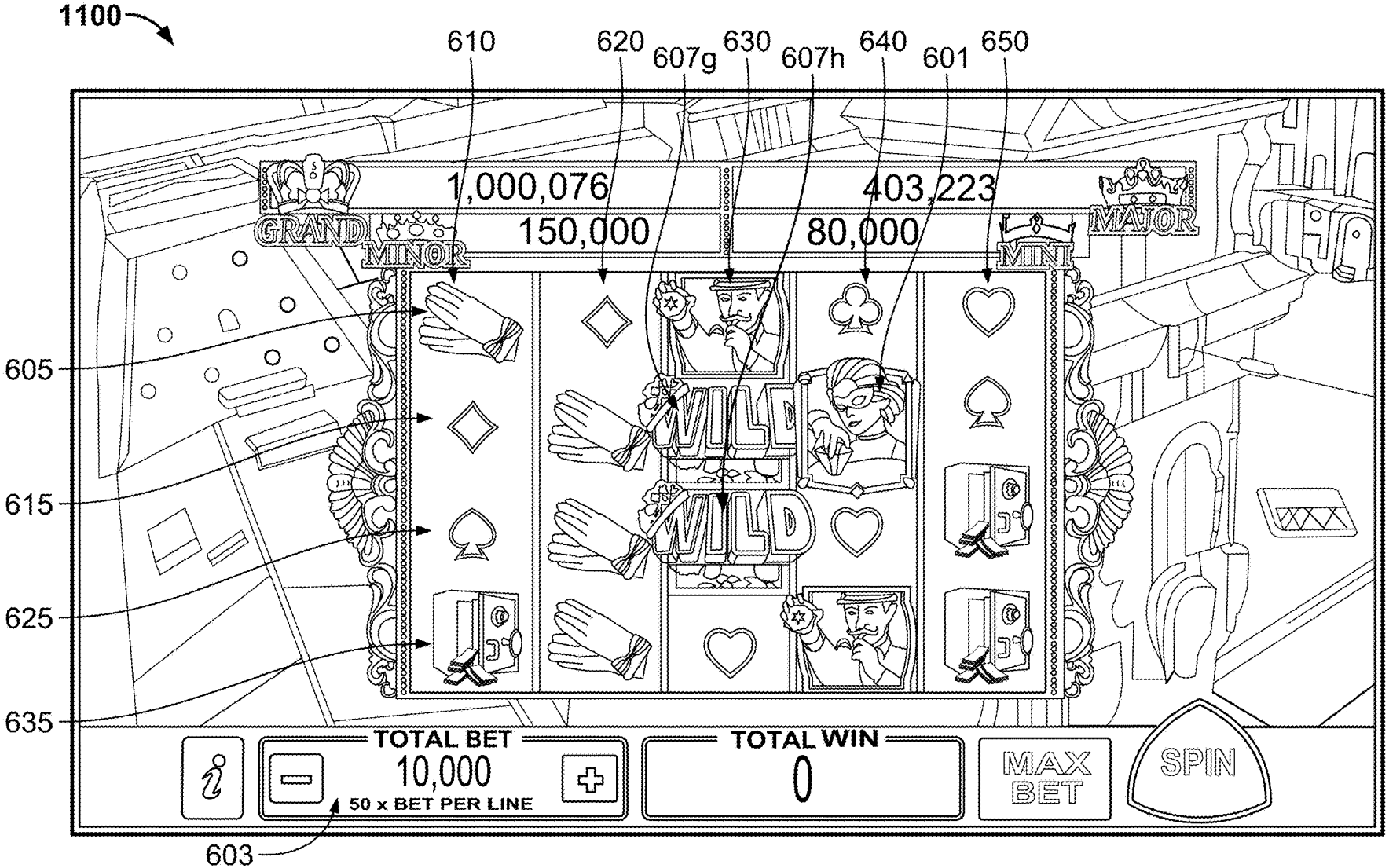
FIG. 11 shows an example of a display that may be presented after the display of FIG. 10 according to some examples.

FIG. 11 shows an example of a display that may be presented after the display of FIG. 10 according to some examples. According to this example, the display 1100 is an example of a game outcome presentation that may be displayed during the next game instance after the game instance that is represented in FIG. 10. FIG. 11 shows an example of a game outcome presentation for what may be referred to herein as a "fourth instance" of the slot game. Exploding wild symbols 607*g* and 607*h* are presented adjacent to the persistent moving symbol 601 in this example. In this example, the persistent moving symbol 601 has remained in row 615, but has moved from column 630 to column 640. In this implementation, because the tertiary persistent moving symbol position was not a prize-triggering persistent moving symbol position, it was predetermined that one of the display symbols for the fourth instance of the slot game would be the persistent moving symbol. The quaternary persistent moving symbol position was also predetermined according to this example: it was predetermined that the quaternary persistent moving symbol position would be in the same row as the prize-triggering persistent moving symbol position, but one column closer to the prize-triggering persistent moving symbol position.

Figure 12:
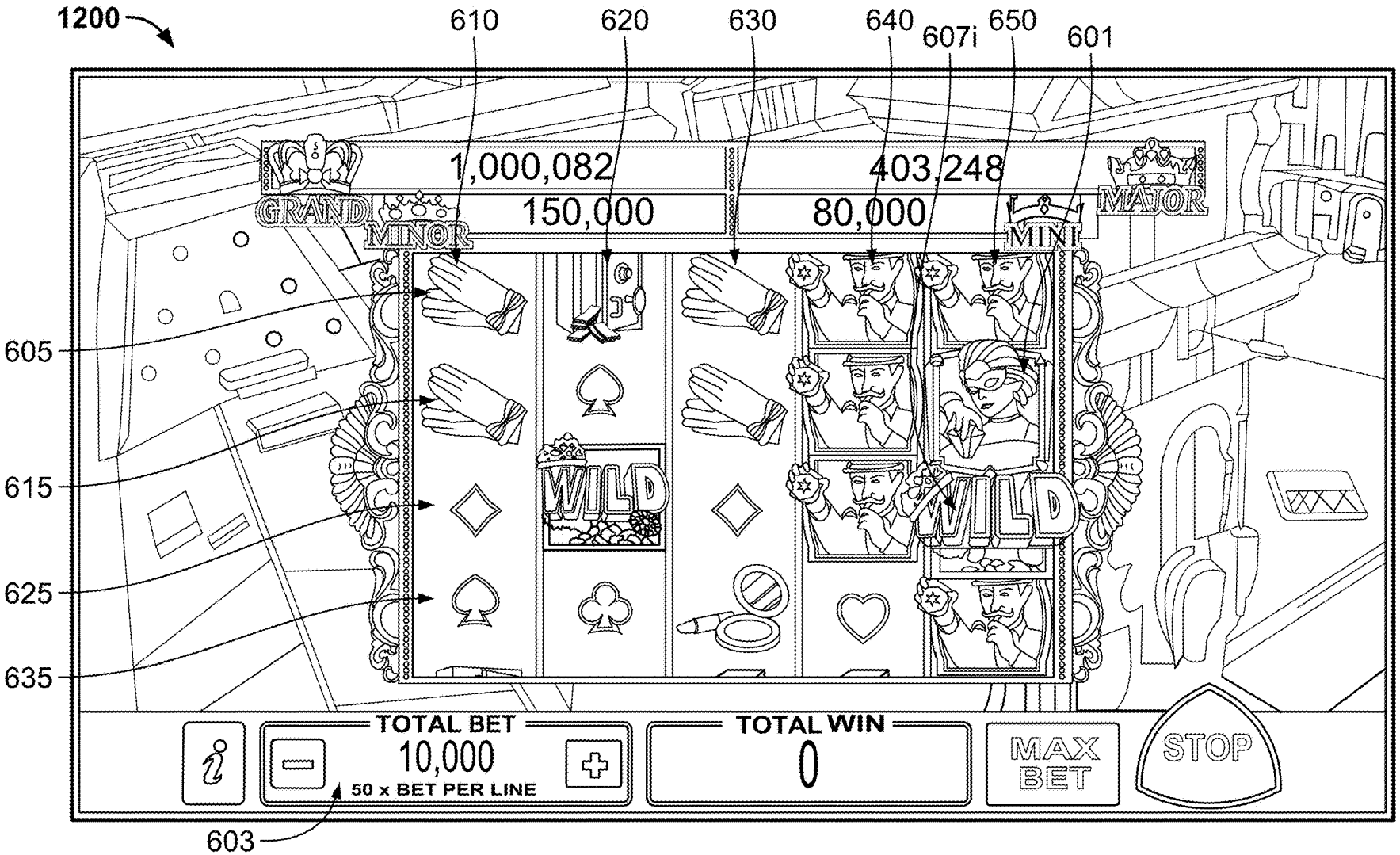
FIG. 12 shows an example of a display that may be presented after the display of FIG. 11 according to some examples.

FIG. 12 shows an example of a display that may be presented after the display of FIG. 11 according to some examples. According to this example, the display 1200 is an example of a game outcome presentation that may be displayed during the next game instance after the game instance that is represented in FIG. 11. FIG. 12 shows an example of a game outcome presentation for what may be referred to herein as a "fifth instance" of the slot game. Exploding wild symbol 607*i* is presented adjacent to the persistent moving symbol 601 in this example. In this example, the persistent moving symbol 601 has remained in row 615, but has moved from column 640 to column 650 and has arrived at the prize-triggering persistent moving symbol position. In this implementation, because the quaternary persistent moving symbol position was not a prize-triggering persistent moving symbol position, it was predetermined that one of the display symbols for the fifth instance of the slot game would be the persistent moving symbol. The quinary persistent moving symbol position was also predetermined according to this example.

Figure 13:
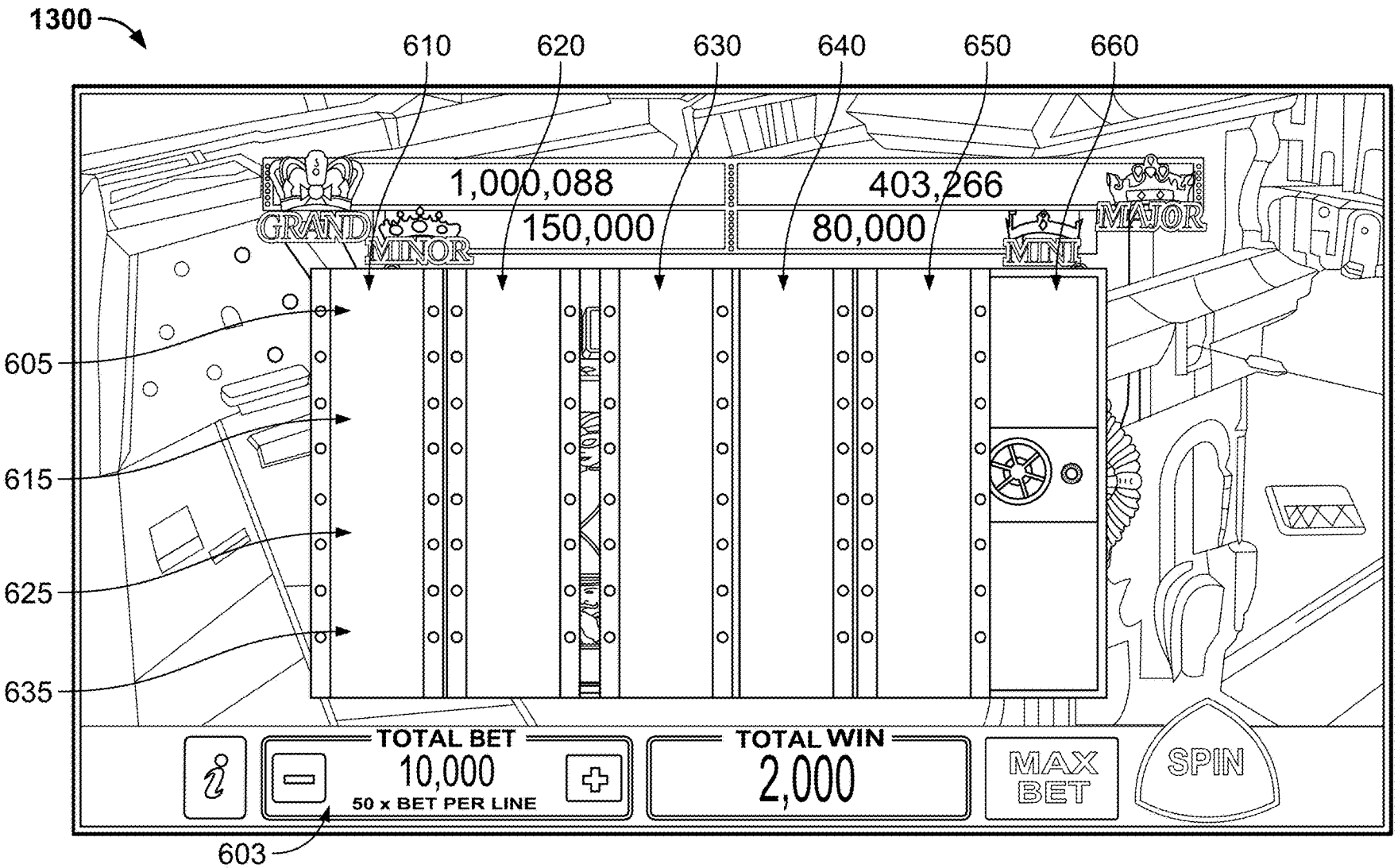
FIG. 13 shows an example of a display that may be presented after the display of FIG. 12 according to some examples.

FIG. 13 shows an example of a display that may be presented after the display of FIG. 12 according to some examples. According to some examples, the control system may be configured for controlling the display system to present a feature game when it is determined that a persistent moving symbol position is a prize-triggering persistent moving symbol position. The display 1300 is an example of a transitional image that is presented after an outcome for the fifth instance of the base slot game is presented, but before the GUI that shows features for presenting the feature game. In this example, the transitional image is one of several transitional images of laser lights, metal doors or panels closing, as if in response to the detection of a cat burglar. In some such examples, corresponding whistles, alarms and/or other related sounds may be presented via speakers of a gaming device.

Figure 14:
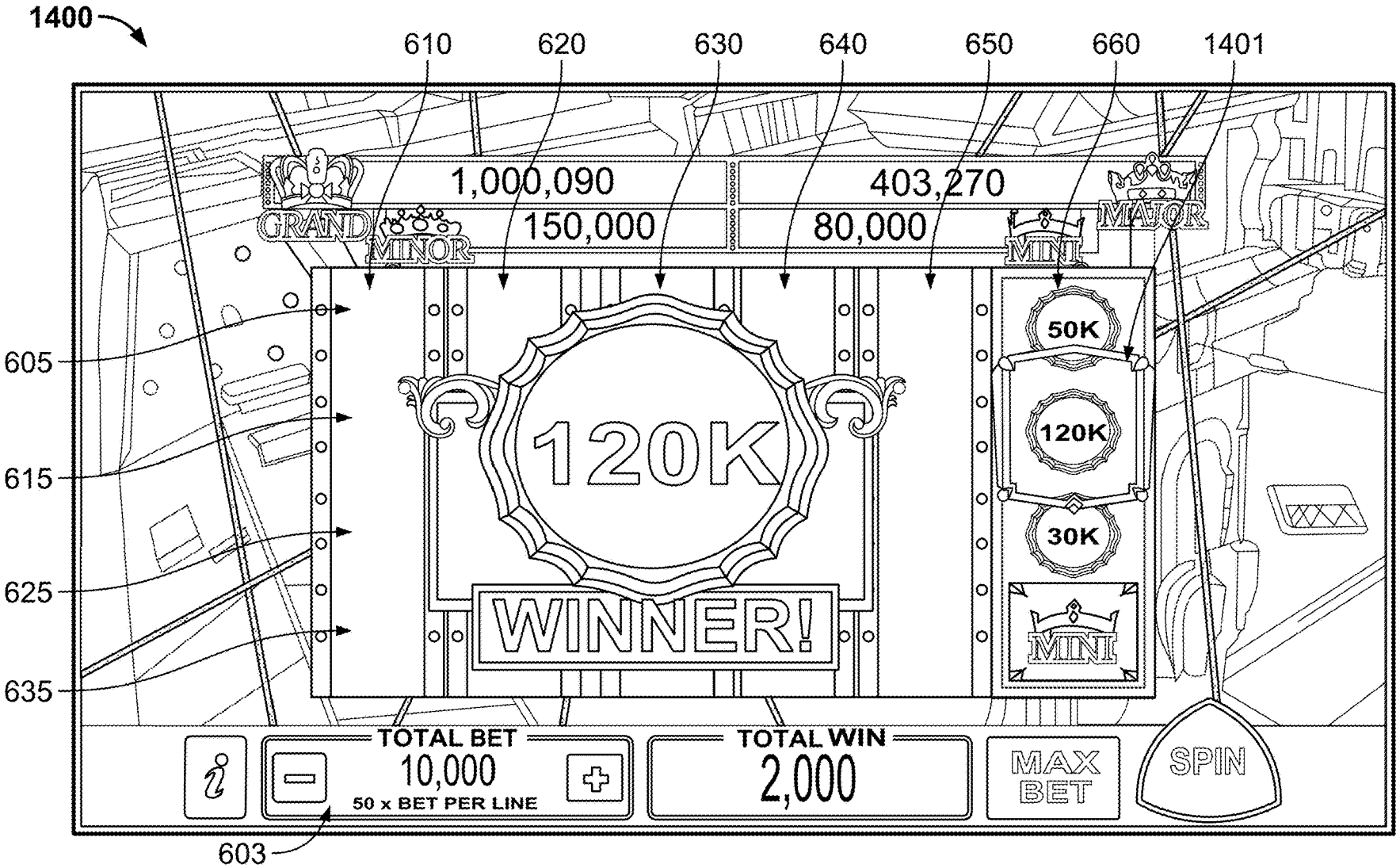
FIG. 14 shows an example of a display that may be presented after the display of FIG. 13 according to some examples.

FIG. 14 shows an example of a display that may be presented after the display of FIG. 13 according to some examples. The display 1400 is an example of GUI that shows features for presenting the feature game. In this example, presenting the feature game involves presenting an additional reel and presenting images that simulate spinning the additional reel to reveal an award of the feature game. According to this example, the additional reel is presented in column 660. In this example, the frame 1401 surrounds the display symbol that corresponds to the award of the feature game, which is 120,000 credits in this example. In this instance, no jackpot can be awarded in the feature game because the bet level was too low for any of the jackpots to be unlocked.

Figure 15:
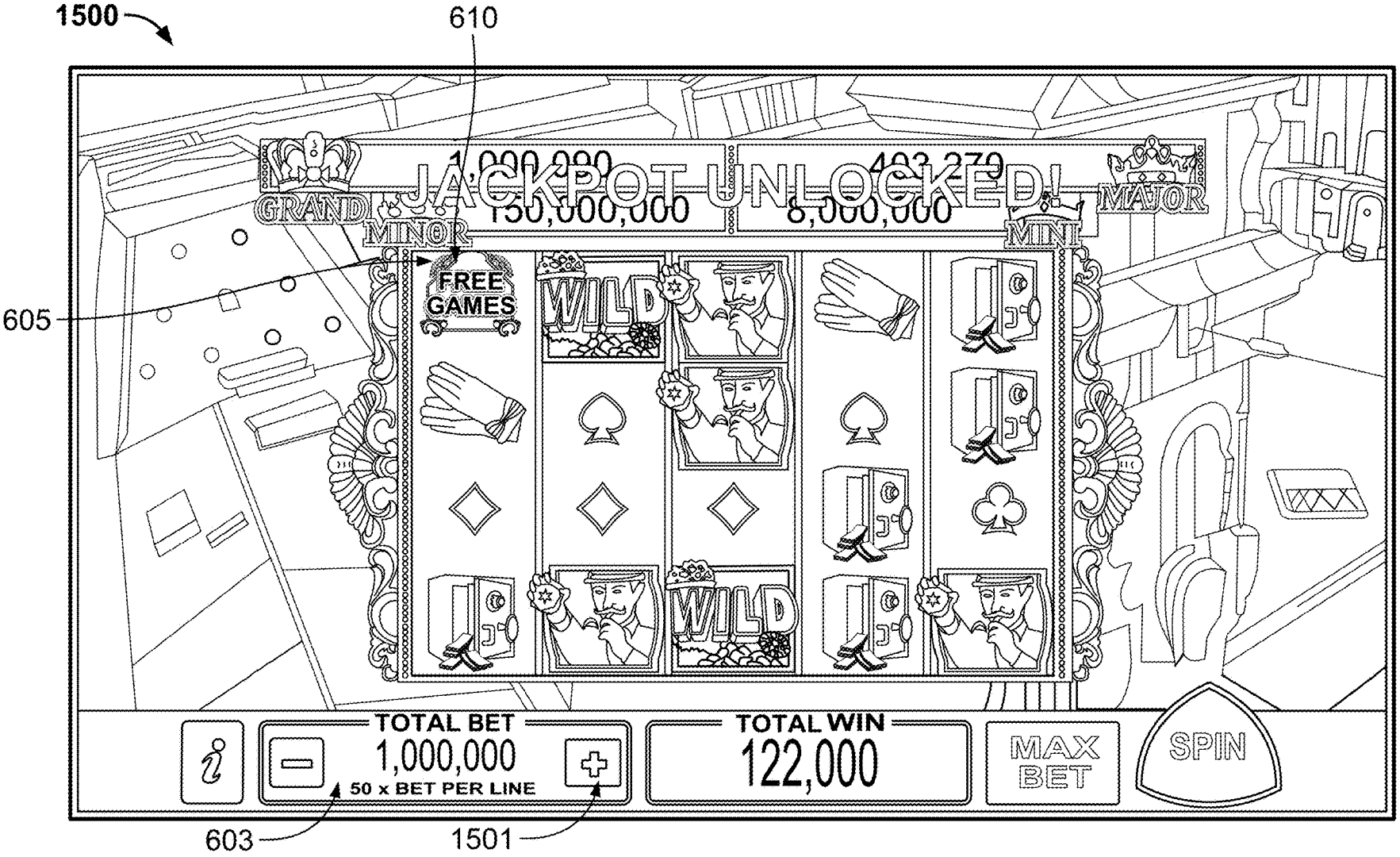
FIG. 15 shows another example of a display that may be presented according to some implementations of the method of FIG. 5.

FIG. 15 shows another example of a display that may be presented according to some implementations of the method of FIG. 5. In this example, the display 1500 shows that the bet meter 603 now indicates a total bet of 1,000,000 credits per game. According to this implementation, 1,000,000 credits per game is the maximum bet level, corresponding to Bet5 of FIG. 7. At the maximum bet level, all of the available jackpots have been unlocked. In this example, a user has provided user input by clicking on icon 1501 of the bet meter 603 until a desired wager level was reached. The user could have attained the same result by interacting with the "Max Bet" icon. The persistent moving symbol 601 did not land in the game outcome shown in FIG. 15, although a free game symbol landed in row 605, column 610.

Figure 16:
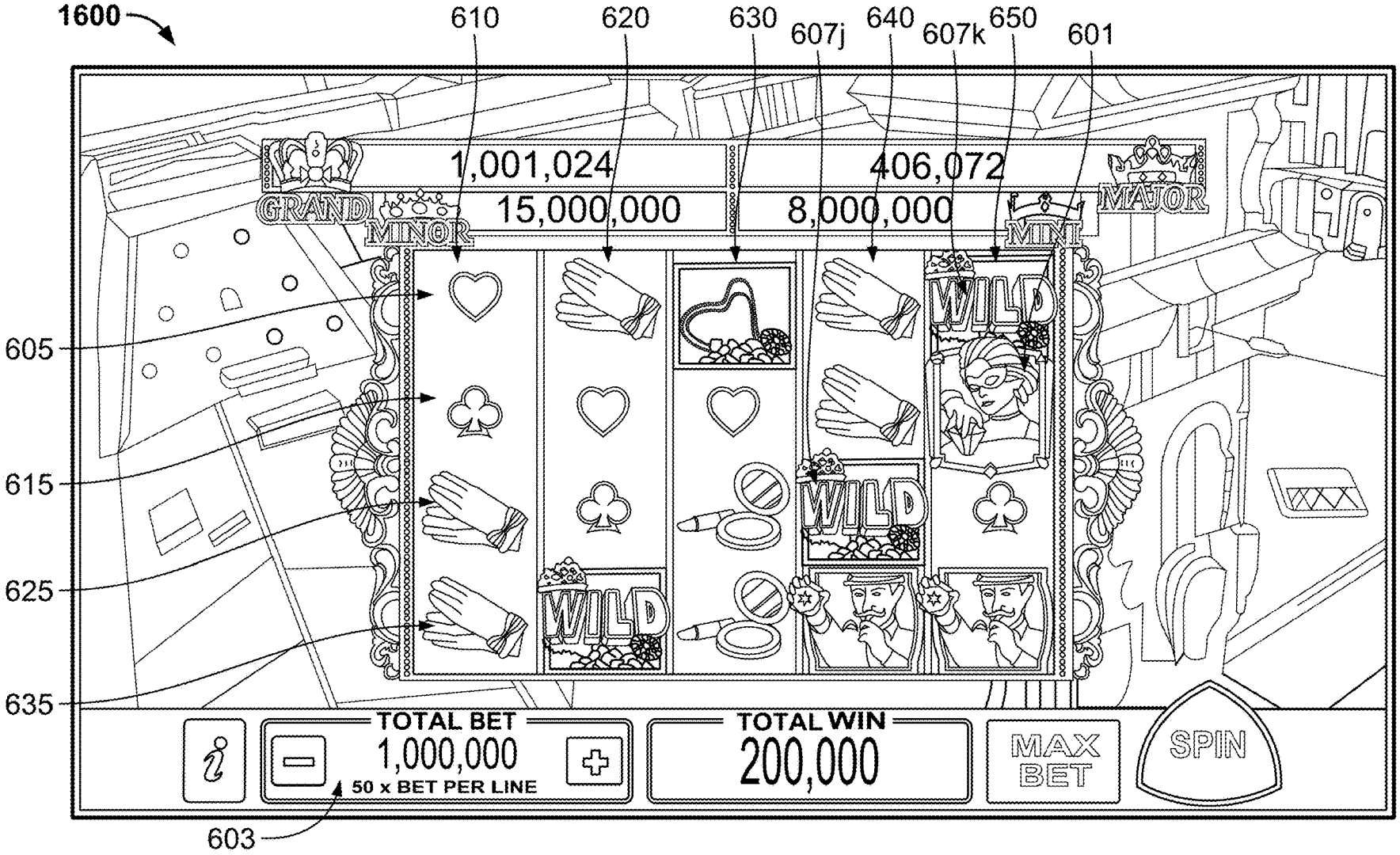
FIG. 16 shows an example of a display that may be presented after the display of FIG. 15 according to some examples.

FIG. 16 shows an example of a display that may be presented after the display of FIG. 15 according to some examples. In the particular game outcome shown in FIG. 16, the control system determined that one of the display symbols of the game outcome would be a persistent moving symbol 601. In this example, the initial persistent moving symbol position is at column 650, row 615. In this example, the initial persistent moving symbol position is a prize-triggering persistent moving symbol position. According to this example, exploding wild symbols 607*j* and 607*k* are presented adjacent to the persistent moving symbol 601.

Figure 17:
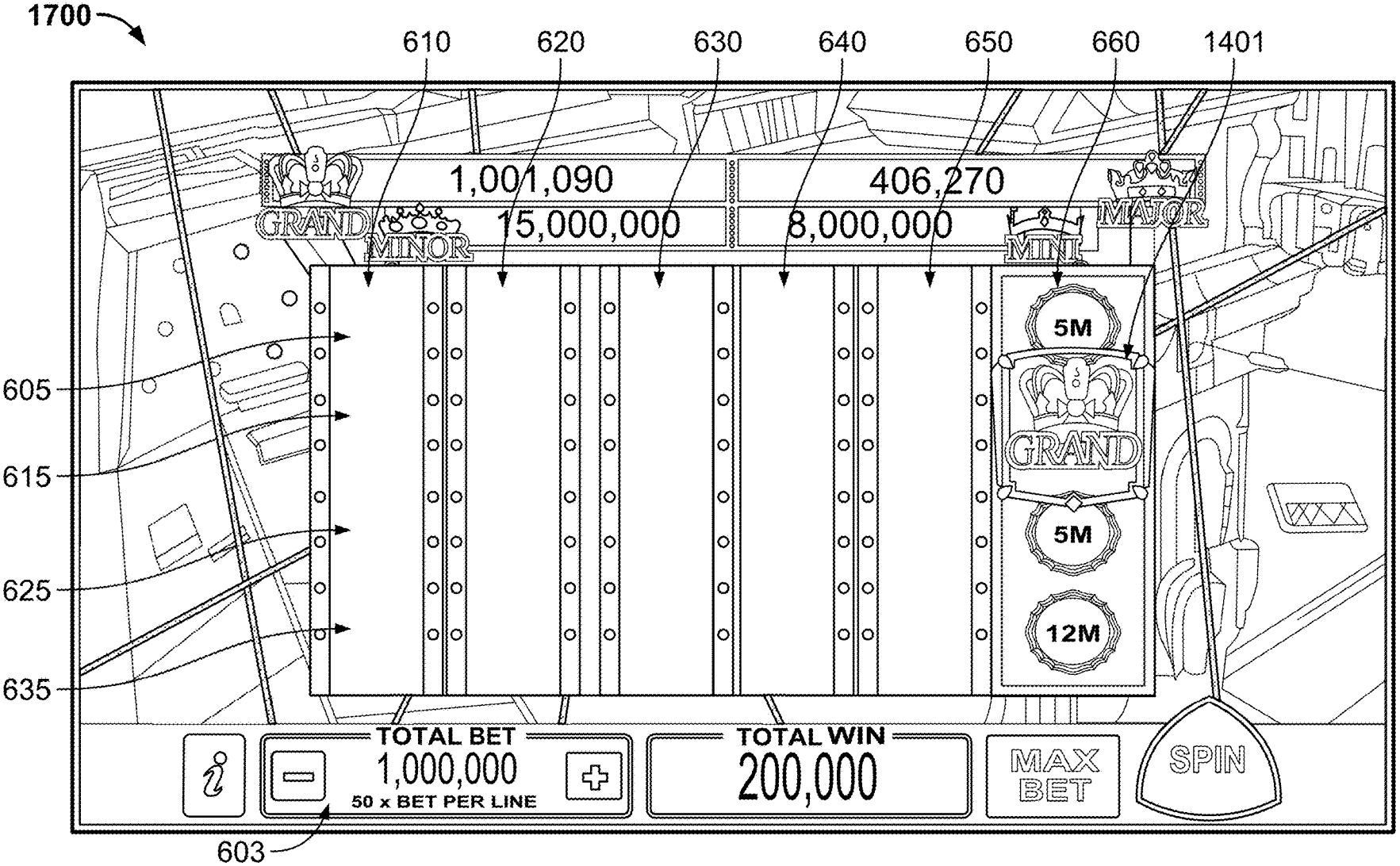
FIG. 17 shows an example of a display that may be presented after the display of FIG. 16 according to some examples.

FIG. 17 shows an example of a display that may be presented after the display of FIG. 16 according to some examples. The display 1700 is another example of GUI that shows features for presenting the feature game. In this example, presenting the feature game involves presenting an additional reel and presenting images that simulate spinning the additional reel to reveal an award of the feature game. According to this example, the additional reel is presented in column 660. In this instance, any of the jackpots could potentially be awarded in the feature game because the bet level was high enough to unlock all of the jackpots. In this example, the frame 1401 surrounds the display symbol that corresponds to the award of the feature game, which is the grand jackpot in this example.

Figure 18:
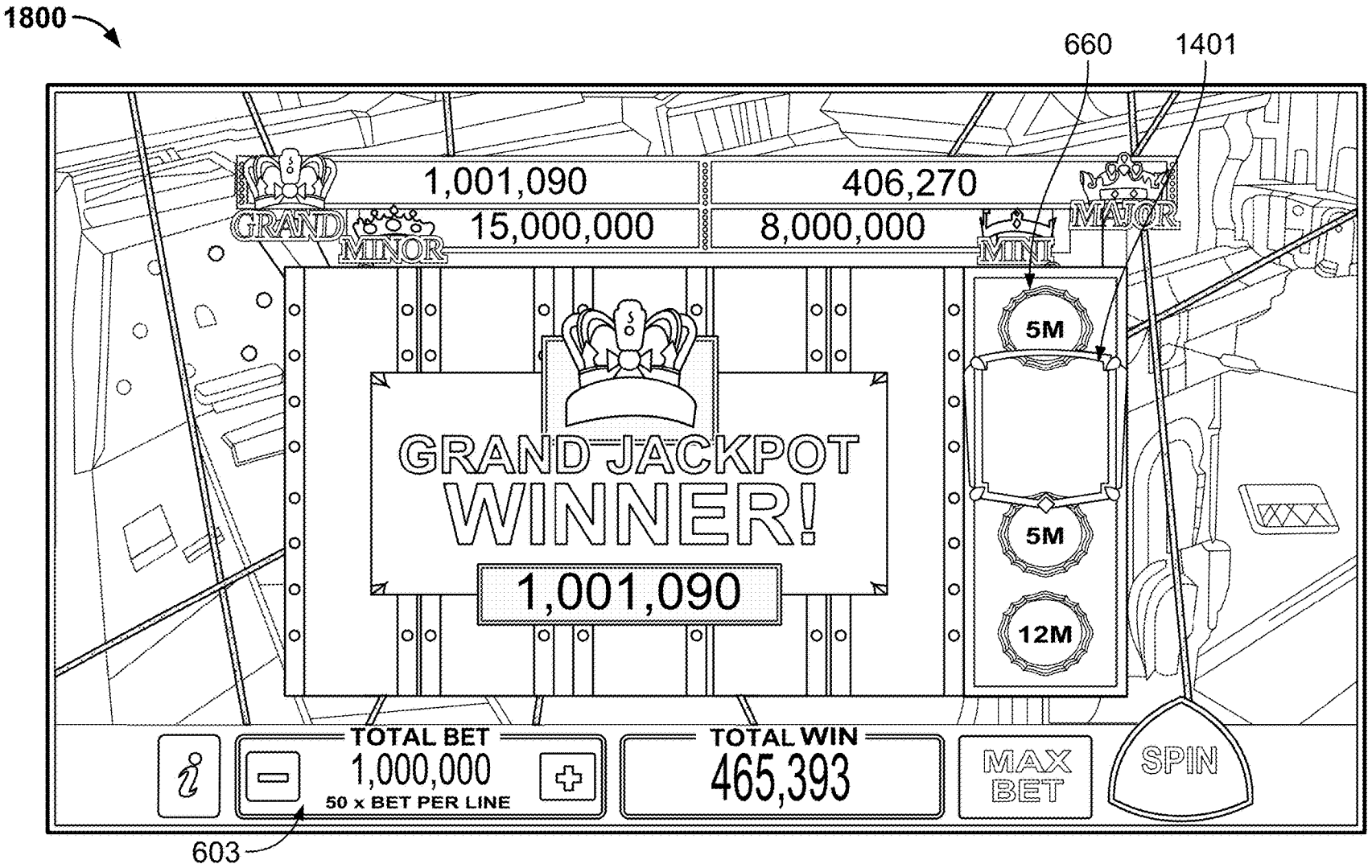
FIG. 18 shows an example of a display that may be presented after the display of FIG. 17 according to some examples.

FIG. 18 shows an example of a display that may be presented after the display of FIG. 17 according to some examples. The display 1800 includes an image that is part of a celebration of winning the grand jackpot during the feature game.

Figure 19:
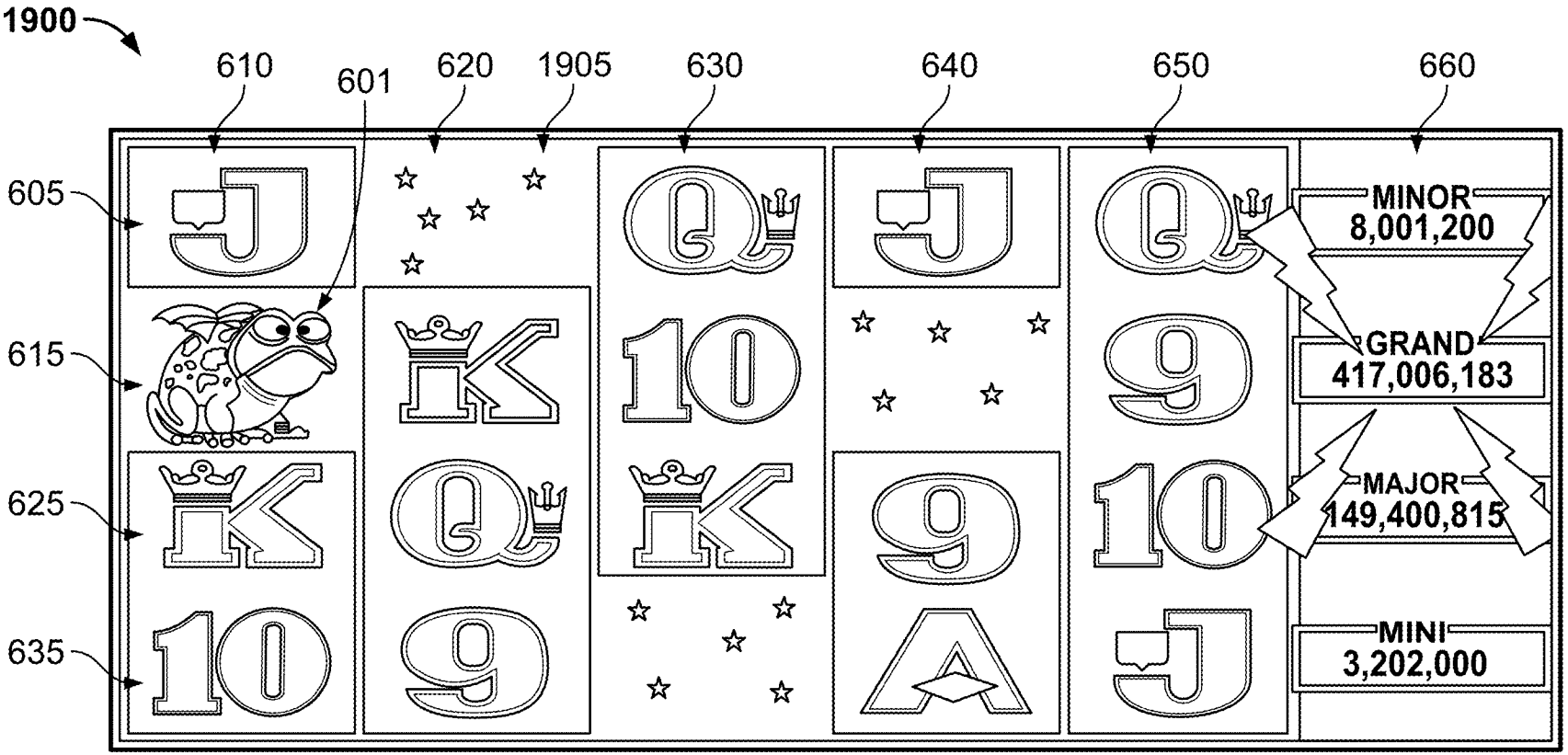
FIG. 19 shows an example of a display that may be presented according to an alternative implementation of the method of FIG. 5.

FIG. 19 shows an example of a display that may be presented according to an alternative implementation of the method of FIG. 5. In this example, the display 1900 shows a different type of persistent moving symbol 601. In this example, the initial persistent moving symbol position is at column 610, row 615.

In this example, the initial persistent moving symbol position is not a prize-triggering persistent moving symbol position. According to this example, all of the rows (605-635) of column 650 are prize-triggering persistent moving symbol positions. Accordingly, this is an example in which prize-triggering persistent moving symbol positions are arranged in a prize-triggering display symbol column. In alternative examples, a plurality of prize-triggering persistent moving symbol positions may be arranged in a display symbol row.

In this implementation, the prize triggered by the prize-triggering persistent moving symbol position is always a progressive jackpot. In this example, each of the progressive jackpots corresponds to an initial display symbol row. Here, the progressive jackpot that corresponds to the initial display symbol row is one of a plurality of progressive jackpots. A prize symbol for each of the plurality of progressive jackpots is displayed adjacent the plurality of prize-triggering persistent moving symbol positions. In this example, prize symbols corresponding to prizes triggered by each of the prize-triggering persistent moving symbol positions are displayed in prize symbol column 660. In alternative examples, a plurality of prize symbols may be arranged in a display symbol row.

The persistent moving symbol 601 may, in some examples, need to traverse along the row 615 from column 610 to 650 in order to trigger an award indicated by the adjacent prize symbol. In some implementations, the persistent moving symbol 601 may move by one column along the row 615 during each successive game instance. However, in this example, an "open space" symbol 1905 needs to land in a column adjacent to the persistent moving symbol 601 and in the direction of the prize-triggering persistent moving symbol position in order for the persistent moving symbol 601 to advance towards the prize-triggering persistent moving symbol position.

Figure 20:
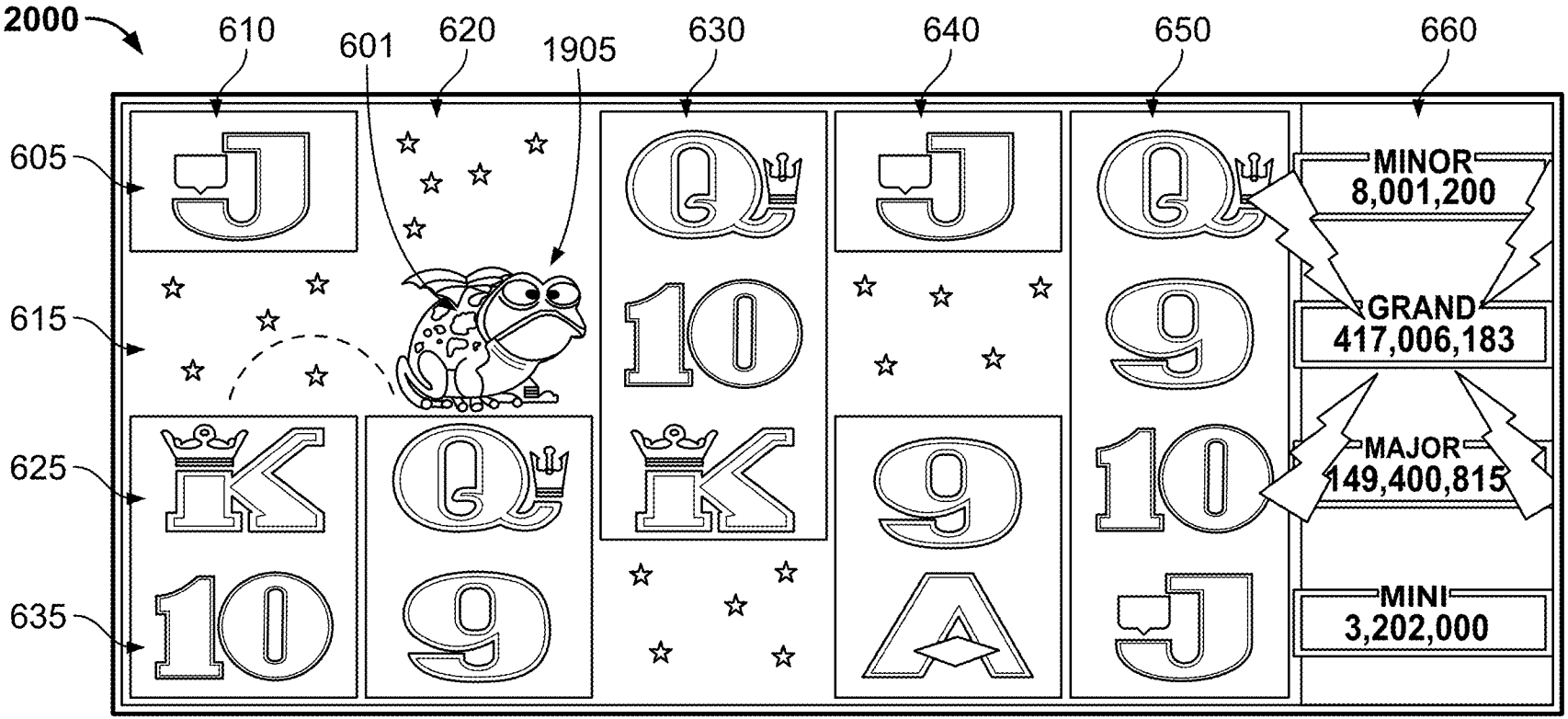
FIG. 20 shows an example of a display that may be presented after the display of FIG. 19 according to some examples.

FIG. 20 shows an example of a display that may be presented after the display of FIG. 19 according to some examples. The display 2000 may or may not correspond to the game instance immediately following the game instance depicted in FIG. 19, depending on the particular implementation. However, in this example the game outcome included an "open space" symbol 1905 in row 615, column 620, allowing the persistent moving symbol 601 to move one column in the direction of the prize-triggering persistent moving symbol position of row 615, column 650.

Figure 21:
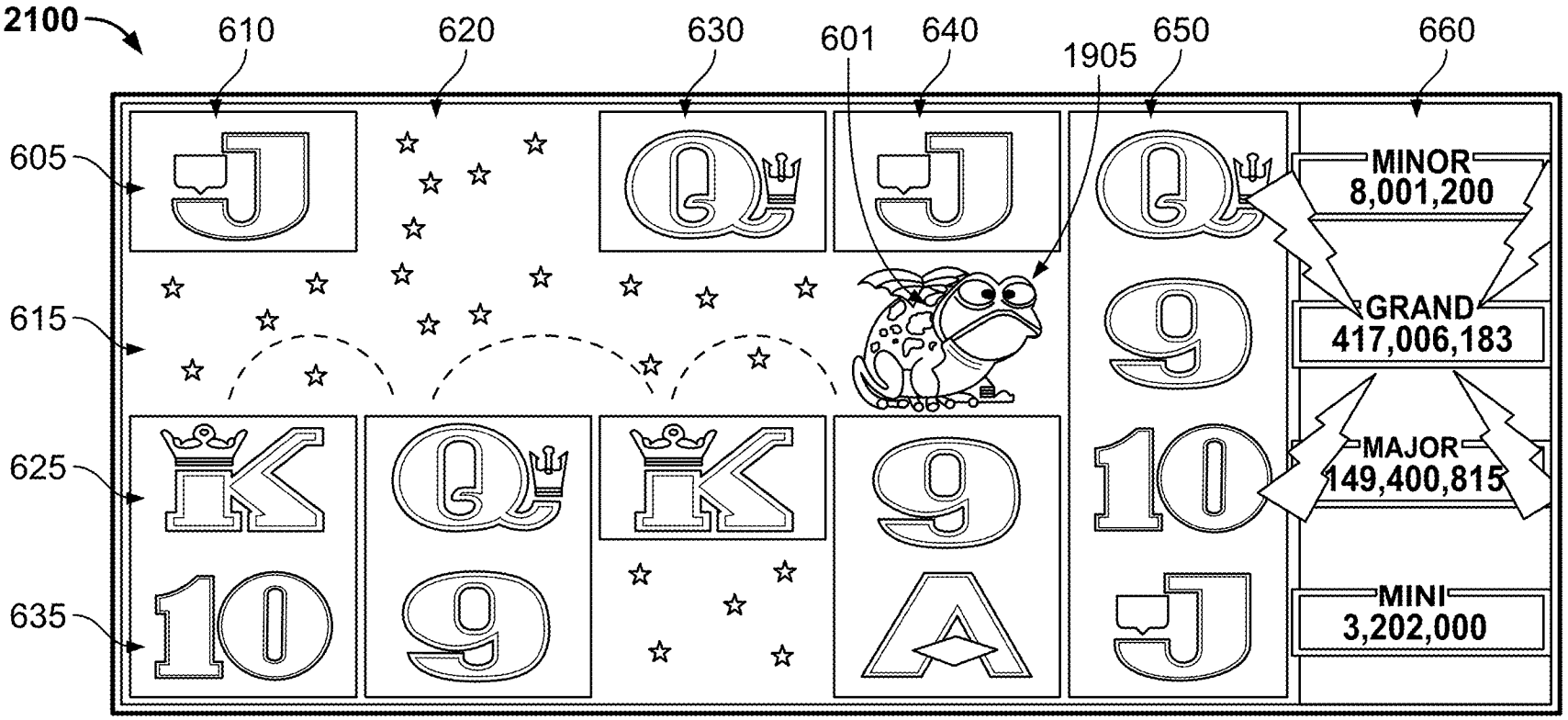
FIG. 21 shows an example of a display that may be presented after the display of FIG. 20 according to some examples.

FIG. 21 shows an example of a display that may be presented after the display of FIG. 20 according to some examples. The display 2100 may or may not correspond to the game instance immediately following the game instance depicted in FIG. 20, depending on the particular implementation. By the time of the game outcome that is shown in FIG. 21, two "open space" symbols 1905 have landed in row 615, columns 630 and 640, allowing the persistent moving symbol 601 to move two more columns in the direction of the prize-triggering persistent moving symbol position in this example.

Figure 22:
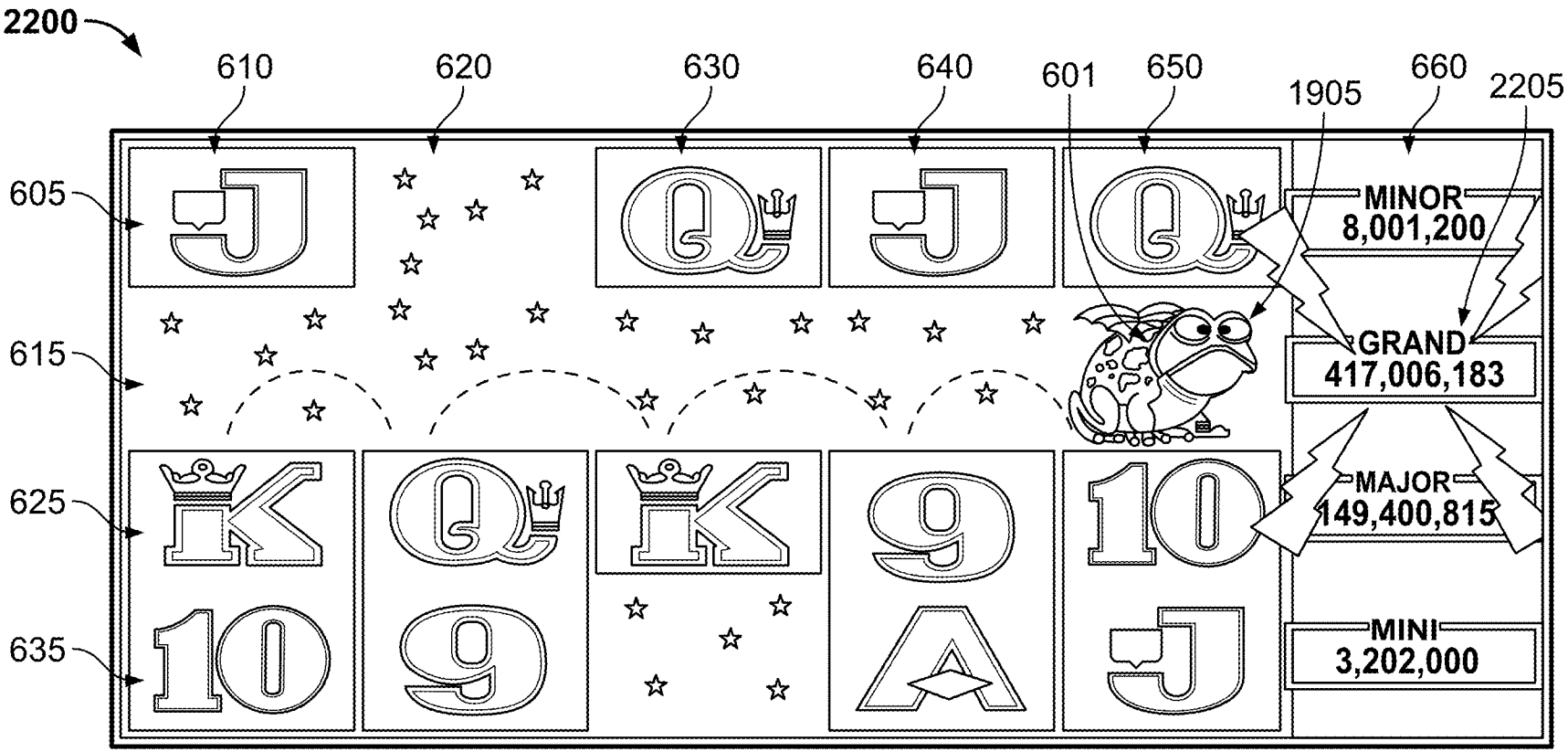
FIG. 22 shows an example of a display that may be presented after the display of FIG. 21 according to some examples.

FIG. 22 shows an example of a display that may be presented after the display of FIG. 21 according to some examples. The display 2200 may or may not correspond to the game instance immediately following the game instance depicted in FIG. 21, depending on the particular implementation. However, in this example the game outcome included an "open space" symbol 1905 in row 615, column 650, allowing the persistent moving symbol 601 to move to the prize-triggering persistent moving symbol position of row 615, column 650 and to trigger an award of the grand jackpot 2205.

In the implementation that is shown in FIGS. 19-22, each of the prize symbols remains in the same row of the prize symbol column 660 during multiple instances of the slot game. However, in alternative implementations, at least one of the prize symbols may be a moving prize symbol. The moving prize symbol may, for example, be displayed in a different row of the prize symbol column 660 during various instances of the slot game. The moving prize symbol may or may not change its position during each game instance, depending on the particular implementation.

According to some such implementations, at least one moving prize symbol may correspond to or match the persistent moving symbol. In some such implementations, a moving prize symbol that corresponds to the persistent moving symbol may also correspond to a maximum prize that may be obtained when the persistent moving symbol is in the prize-triggering persistent moving symbol position. For example, a color and/or pattern of the persistent moving symbol may match a color and/or pattern of the moving prize symbol. In other examples, the persistent moving symbol and the moving prize symbol may represent characters that could be coupled with one another, such as bride and groom symbols, prince and princess symbols, king and queen symbols, etc.

In some implementations, a moving prize symbol may advance along a predetermined trajectory. According to some such implementations, a moving prize symbol may be shown as climbing a tree or a ladder, ascending up a tower, etc. In other examples, the moving prize symbol may be depicted as moving along a track, such as a track that borders the display symbol positions. The moving prize symbol may or may not change its position along the predetermined trajectory during each game instance, depending on the particular implementation.

While specific examples have been described with respect to the figures, it will be appreciated that many modifications and changes may be made by those skilled in the art without departing from the scope of the present disclosure. For example, although some examples are described as embodiments of base games, the concepts disclosed herein can also be applied to other types of games, such as feature games or bonus games, e.g., free spins of a slot game. Similarly, although some examples are described as embodiments of feature games or bonus games, e.g., free spins of a slot game, the concepts disclosed herein can also be applied to other types of games, such as base games. Any variation and derivation from the above description and figures are included in the scope of the present disclosure as defined by the claims.

The invention claimed is:

1. A gaming device, comprising:

a display system including one or more displays;

an interface system including at least one network interface and at least one user interface; and a control system including one or more processors, the control system being configured for:

receiving, via the interface system, user input corresponding to a first bet level;

receiving, via the interface system, user input for initiation of a first instance of a slot game;

determining a first game outcome and corresponding first display symbols for the first instance of the slot game, wherein:

determining the first game outcome involves determining that one of the first display symbols is a persistent moving symbol, the persistent moving symbol having a frame at least partially surrounding an image;

determining the first game outcome involves determining an initial persistent moving symbol position that is based, at least in part, on the first bet level; and determining the first game outcome involves determining whether the initial persistent moving symbol position is a prize-triggering persistent moving symbol position;

controlling the display system to display the first game outcome, wherein displaying the first game outcome involves displaying the first display symbols at a plurality of display symbol positions on a display device of the display system, wherein the plurality of display symbol positions are arranged in a plurality of display symbol rows and display symbol columns;

receiving, via the interface system, user input for initiation of a second instance of the slot game;

determining a second game outcome and corresponding second display symbols for the second instance of the slot game, wherein, if determining the first game outcome involved determining that the initial persistent moving symbol position was not a prize-triggering persistent moving symbol position, determining the second game outcome involves:

determining that one of the second display symbols is the persistent moving symbol;

determining that a secondary persistent moving symbol position will be a display symbol position that is at least one of a display symbol row or a display symbol column towards the prize-triggering persistent moving symbol position, relative to the initial persistent moving symbol position;

controlling the display system to display the second game outcome; and controlling, in response to determining that the second game outcome involved determining that the secondary persistent moving symbol position was a prize-triggering persistent moving symbol position, the display system to display a feature game outcome, wherein the feature game outcome involves:

displaying a new display symbol column adjacent to the display symbol column in which the secondary persistent moving symbol position is located, wherein the new display symbol column includes a plurality of prize-triggering persistent moving symbol positions, displaying the frame of the persistent moving symbol, and not displaying the image of the persistent moving symbol, at least partially around one of the prize-triggering persistent moving symbol positions in the new display symbol column, displaying an award of the feature game in the one prize-triggering persistent moving symbol positions that the frame of the persistent moving symbol at least partially surrounds, and displaying visual effects corresponding to providing the award of the feature game to the user.

2. The gaming device of claim 1, wherein the initial persistent moving symbol position is an initial display symbol row and an initial display symbol column and wherein the initial display symbol column corresponds to the first bet level.

3. The gaming device of claim 1, wherein displaying the second game outcome involves presenting the persistent moving symbol in a secondary persistent moving symbol position, the secondary persistent moving symbol position being the initial display symbol row and a secondary display symbol column, the secondary display symbol column being adjacent to the initial display symbol column.

4. The gaming device of claim 3, wherein a prize triggered by the prize-triggering persistent moving symbol position is a progressive jackpot.

5. The gaming device of claim 1, wherein the prize-triggering persistent moving symbol position is one of a plurality of prize-triggering persistent moving symbol positions.

6. The gaming device of claim 1, wherein determining the first game outcome involves making a random number generator (RNG) call to a game processing backend system to determine whether one or more wild symbols will be presented adjacent to the initial persistent moving symbol position.

7. The gaming device of claim 1, wherein the control system is further configured for determining whether one of the first display symbols is a persistent moving symbol and wherein determining whether one of the first display symbols is a persistent moving symbol involves:

making a random number generator (RNG) call to a game processing backend system;

determining an RNG outcome based on the RNG call; and providing the RNG outcome to an RNG conversion engine, wherein the RNG conversion engine refers to a weighted lookup table in order to determine whether one of the first display symbols is a persistent moving symbol.

8. The gaming device of claim 1, wherein the initial persistent moving symbol position is not the prize-triggering persistent moving symbol position and wherein the control system is further configured to award a multiplier at a display symbol position between the initial persistent moving symbol position and the prize-triggering persistent moving symbol position.

9. A method of controlling an electronic gaming machine, the method comprising:

receiving, via an interface system of a gaming device, the interface system including at least one network interface and at least one user interface, user input corresponding to a first bet level;

receiving, via the interface system, user input for initiation of a first instance of a slot game;

determining, via a control system including one or more processors, a first game outcome and corresponding first display symbols for the first instance of the slot game, wherein:

determining the first game outcome involves determining that one of the first display symbols is a persistent moving symbol, the persistent moving symbol having a frame at least partially surrounding an image;

determining, via the control system, the first game outcome involves determining an initial persistent moving symbol position that is based, at least in part, on the first bet level; and determining, via the control system, the first game outcome involves determining whether the initial persistent moving symbol position is a prize-triggering persistent moving symbol position;

controlling, via the control system, a display system including one or more displays to display the first game outcome, wherein displaying the first game outcome involves displaying, via the display system, the first display symbols at a plurality of display symbol positions on a display device of the display system, wherein the plurality of display symbol positions are arranged in a plurality of display symbol rows and display symbol columns;

receiving, via the interface system, user input for initiation of a second instance of the slot game;

determining, via the control system, a second game outcome and corresponding second display symbols for the second instance of the slot game, wherein, if determining the first game outcome involved determining that the initial persistent moving symbol position was not a prize-triggering persistent moving symbol position, determining the second game outcome involves:

determining, via the control system, that one of the second display symbols is the persistent moving symbol;

determining, via the control system, that a secondary persistent moving symbol position will be a display symbol position that is at least one of a display symbol row or a display symbol column towards the prize-triggering persistent moving symbol position, relative to the initial persistent moving symbol position;

controlling, via the control system, the display system to display the second game outcome; and controlling, via the control system and in response to determining that the second game outcome involved determining that the secondary persistent moving symbol position was a prize-triggering persistent moving symbol position, the display system to display a feature game outcome, wherein the feature game outcome involves:

displaying, via the display system, a new display symbol column adjacent to the display symbol column in which the secondary persistent moving symbol position is located, wherein the new display symbol column includes a plurality of prize-triggering persistent moving symbol positions, displaying, via the display system, the frame of the persistent moving symbol, and not displaying the image of the persistent moving symbol, at least partially around one of the prize-triggering persistent moving symbol positions in the new display symbol column, displaying, via the display system, an award of the feature game in the one prize-triggering persistent moving symbol positions that the frame of the persistent moving symbol at least partially surrounds, and displaying, via the display system, visual effects corresponding to providing the award of the feature game to the user.

10. The method of claim 9, wherein the initial persistent moving symbol position is an initial display symbol row and an initial display symbol column and wherein the initial display symbol column corresponds to the first bet level.

11. The method of claim 9, wherein displaying the second game outcome involves presenting the persistent moving symbol in a secondary persistent moving symbol position, the secondary persistent moving symbol position being the initial display symbol row and a secondary display symbol column, the secondary display symbol column being adjacent to the initial display symbol column.

12. The method of claim 11, wherein a prize triggered by the prize-triggering persistent moving symbol position is a progressive jackpot.

13. The method of claim 9, wherein the prize-triggering persistent moving symbol position is one of a plurality of prize-triggering persistent moving symbol positions.

14. The method of claim 9, wherein determining the first game outcome involves making a random number generator (RNG) call to a game processing backend system to determine whether one or more wild symbols will be presented adjacent to the initial persistent moving symbol position.

15. One or more non-transitory media having software stored thereon, the software including instructions for a method of controlling an electronic gaming machine, the method comprising:

receiving, via an interface system of a gaming device, the interface system including at least one network interface and at least one user interface, user input corresponding to a first bet level;

receiving, via the interface system, user input for initiation of a first instance of a slot game;

determining, via a control system including one or more processors, a first game outcome and corresponding first display symbols for the first instance of the slot game, wherein:

determining the first game outcome involves determining that one of the first display symbols is a persistent moving symbol, the persistent moving symbol having a frame at least partially surrounding an image;

determining, via the control system, the first game outcome involves determining an initial persistent moving symbol position that is based, at least in part, on the first bet level; and determining, via the control system, the first game outcome involves determining whether the initial persistent moving symbol position is a prize-triggering persistent moving symbol position;

controlling, via the control system, a display system including one or more displays to display the first game outcome, wherein displaying the first game outcome involves displaying, via the display system, the first display symbols at a plurality of display symbol positions on a display device of the display system, wherein the plurality of display symbol positions are arranged in a plurality of display symbol rows and display symbol columns;

receiving, via the interface system, user input for initiation of a second instance of the slot game;

determining, via the control system, a second game outcome and corresponding second display symbols for the second instance of the slot game, wherein, if determining the first game outcome involved determining that the initial persistent moving symbol position was not a prize-triggering persistent moving symbol position, determining the second game outcome involves:

determining, via the control system, that one of the second display symbols is the persistent moving symbol;

determining, via the control system, that a secondary persistent moving symbol position will be a display symbol position that is at least one of a display symbol row or a display symbol column towards the prize-triggering persistent moving symbol position, relative to the initial persistent moving symbol position;

controlling, via the control system, the display system to display the second game outcome; and controlling, via the control system and in response to determining that the second game outcome involved determining that the secondary persistent moving symbol position was a prize-triggering persistent moving symbol position, the display system to display a feature game outcome, wherein the feature game outcome involves:

displaying, via the display system, a new display symbol column adjacent to the display symbol column in which the secondary persistent moving symbol position is located, wherein the new display symbol column includes a plurality of prize-triggering persistent moving symbol positions, displaying, via the display system, the frame of the persistent moving symbol, and not displaying the image of the persistent moving symbol, at least partially around one of the prize-triggering persistent moving symbol positions in the new display symbol column, displaying, via the display system, an award of the feature game in the one prize-triggering persistent moving symbol positions that the frame of the persistent moving symbol at least partially surrounds, and displaying, via the display system, visual effects corresponding to providing the award of the feature game to the user.

16. The one or more non-transitory media of claim 15, wherein the initial persistent moving symbol position is an initial display symbol row and an initial display symbol column and wherein the initial display symbol column corresponds to the first bet level.

17. The one or more non-transitory media of claim 15, wherein displaying the second game outcome involves presenting the persistent moving symbol in a secondary persistent moving symbol position, the secondary persistent moving symbol position being the initial display symbol row and a secondary display symbol column, the secondary display symbol column being adjacent to the initial display symbol column.

18. The one or more non-transitory media of claim 17, wherein a prize triggered by the prize-triggering persistent moving symbol position is a progressive jackpot.

19. The one or more non-transitory media of claim 15, wherein the prize-triggering persistent moving symbol position is one of a plurality of prize-triggering persistent moving symbol positions.

20. The one or more non-transitory media of claim 15, wherein determining the first game outcome involves making a random number generator (RNG) call to a game processing backend system to determine whether one or more wild symbols will be presented adjacent to the initial persistent moving symbol position.

* * * * *